US006259077B1

(12) United States Patent
Drozd et al.

(10) Patent No.: US 6,259,077 B1
(45) Date of Patent: Jul. 10, 2001

(54) METHOD AND APPARATUS FOR ELECTROMAGNETIC EXPOSURE OF PLANAR OR OTHER MATERIALS

(75) Inventors: J. Michael Drozd; William T. Joines, both of Durham, NC (US)

(73) Assignee: Industrial Microwave Systems, Inc., Morrisville, NC (US)

( * ) Notice: Subject to any disclaimer, the term of this patent is extended or adjusted under 35 U.S.C. 154(b) by 0 days.

(21) Appl. No.: 09/350,991

(22) Filed: Jul. 12, 1999

(51) Int. Cl.[7] ..... H05B 6/78; H05B 6/74

(52) U.S. Cl. ..... 219/693; 219/692; 219/695; 219/696; 219/700; 219/746; 219/750

(58) Field of Search ..... 219/693, 691, 219/692, 694, 695, 696, 700, 701, 745, 746, 748, 750, 762, 709

(56) References Cited

U.S. PATENT DOCUMENTS

| | | | | |
|---|---|---|---|---|
| Re. 32,664 | | 5/1988 | Osepchuk . | |
| 2,467,230 | * | 4/1949 | Revercomb et al. | 219/693 |
| 2,549,511 | | 4/1951 | Nelson . | |
| 2,650,291 | * | 8/1953 | Kinn | 219/693 |
| 3,471,672 | | 10/1969 | White . | |
| 3,474,209 | | 10/1969 | Parker . | |
| 3,622,733 | | 11/1971 | Smith et al. . | |
| 3,632,945 | | 1/1972 | Johnson . | |
| 3,666,905 | | 5/1972 | Muller et al. . | |
| 3,761,665 | | 9/1973 | Nagao et al. . | |

(List continued on next page.)

FOREIGN PATENT DOCUMENTS

| | | | | |
|---|---|---|---|---|
| 1-274381 | * | 11/1989 | (JP) | 219/693 |
| 2-223186 | * | 9/1990 | (JP) | 219/693 |
| WO98/49870 | | 11/1998 | (WO) . | |

OTHER PUBLICATIONS

S. C. Kashyap et al., "A Waveguide Applicator for Sheet Materials", IEEE Transactions on Microwave Theory and Techniques, vol. 24, No. 2, Feb. 1976, pp. 125–126.

*Primary Examiner*—Philip H. Leung
(74) *Attorney, Agent, or Firm*—Burns, Doane, Swecker & Mathis, L.L.P.

(57) ABSTRACT

A source provides an electromagnetic wave that has a range of frequencies. The source sweeps the frequency of the electromagnetic wave between a cutoff frequency and double the cutoff frequency. The location, angle, or effective angle of an opening is adjusted by an opening adjuster. A path for an electromagnetic wave has a short for creating a standing wave. The path has a movable surface that can push and pull the peaks and valleys of the standing wave so as to achieve more uniform heating of the material. A dielectric wheel pushes and pulls the peaks and valleys of a standing wave so as to achieve more uniform heating of a material. A dielectric structure has a surface that has a short side and a long side. A motor rotates the dielectric structure to push and pull the peaks and valleys of a standing wave so as to achieve more uniform heating of a material. A path has a first choke flange that has a width $w_1$, and a second choke flange that has a width $w_2$. The widths $w_1$, and $w_2$ are selected to minimize the escape of electromagnetic energy from the path. A path has a first choke flange that has a height $h_1$ and a second choke flange that has a height $h_2$. The heights $h_1$, and $h_2$ are selected to minimize the escape of electromagnetic energy from the path. A choke flange has gaps to prevent the flow of electromagnetic energy along the choke flange. A choke flange has a horizontal section and a vertical section. The horizontal section has a narrow dimension to limit the escape of electromagnetic energy from the interior region. The vertical section is located at an end of the horizontal section opposite the opening.

26 Claims, 17 Drawing Sheets

U.S. PATENT DOCUMENTS

| | | | | |
|---|---|---|---|---|
| 3,765,425 | | 10/1973 | Stungis . | |
| 3,843,861 | | 10/1974 | Van Amsterdam . | |
| 3,851,132 | | 11/1974 | Van Koughnett . | |
| 4,108,147 | | 8/1978 | Kantor . | |
| 4,160,144 | | 7/1979 | Kashyap et al. . | |
| 4,196,332 | * | 4/1980 | MacKay B et al. | 219/709 |
| 4,234,775 | | 11/1980 | Wolfberg et al. . | |
| 4,314,128 | * | 2/1982 | Chitre | 219/748 |
| 4,401,873 | | 8/1983 | Berggren et al. . | |
| 4,446,348 | | 5/1984 | Huang . | |
| 4,760,230 | | 7/1988 | Hässler . | |
| 4,999,469 | | 3/1991 | Dudley et al. . | |
| 5,107,602 | | 4/1992 | Lööf . | |
| 5,169,571 | | 12/1992 | Buckley . | |
| 5,278,375 | | 1/1994 | Berteaud et al. . | |
| 5,369,250 | | 11/1994 | Meredith . | |
| 5,402,672 | | 4/1995 | Bradford . | |
| 5,457,303 | | 10/1995 | Shute et al. . | |
| 5,536,921 | | 7/1996 | Hedrick et al. . | |
| 5,798,395 | | 8/1998 | Lauf et al. . | |
| 5,804,801 | | 9/1998 | Lauf et al. . | |
| 5,879,756 | | 3/1999 | Fathi et al. . | |
| 5,958,275 | * | 9/1999 | Joines et al. | 219/693 |

* cited by examiner

FIG. 9a
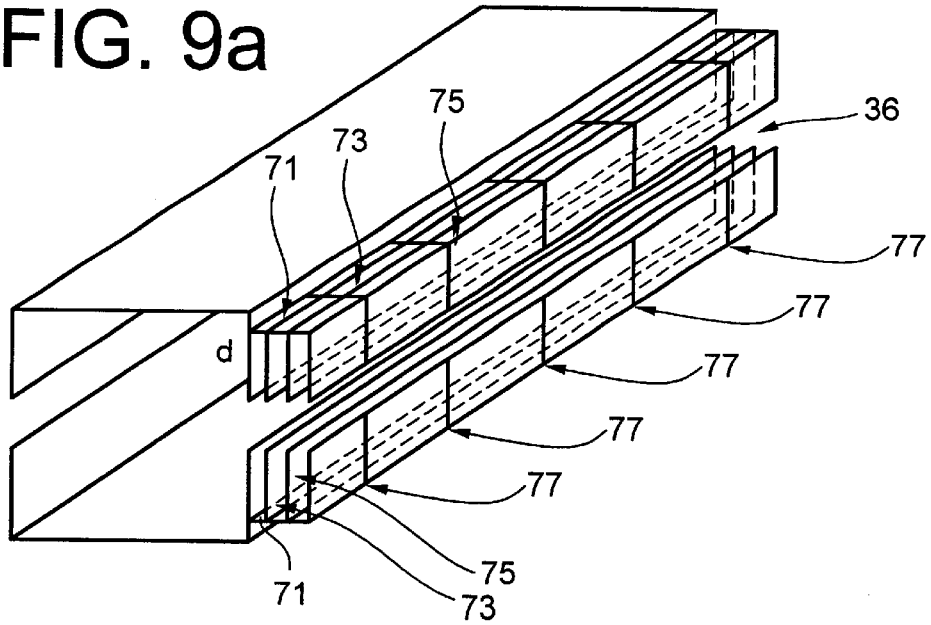
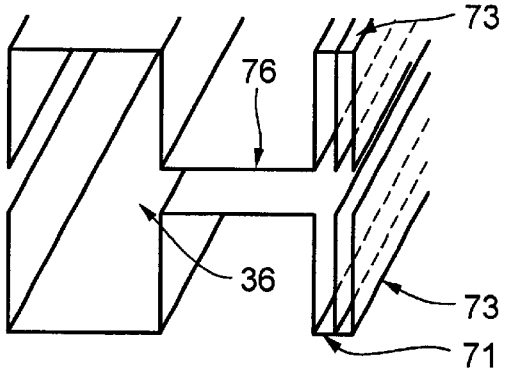
FIG. 9b
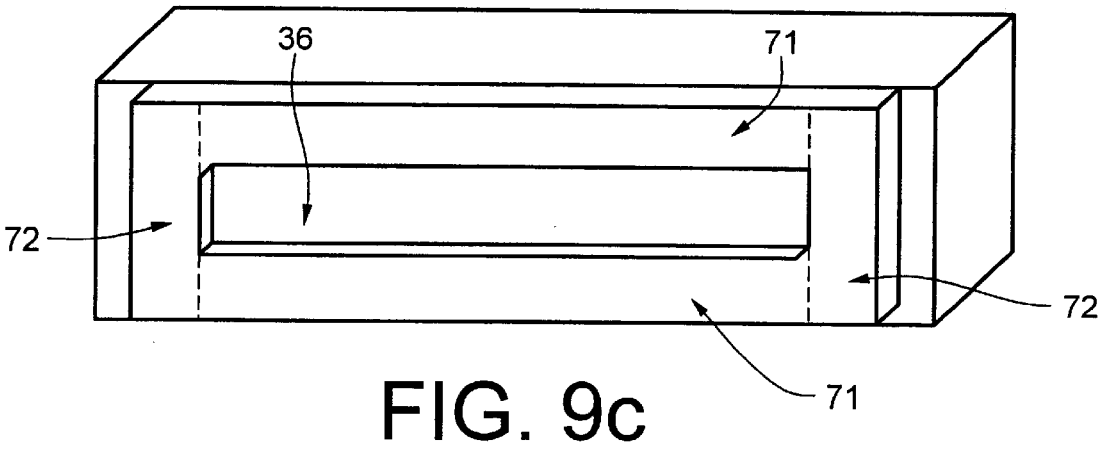
FIG. 9c

METHOD AND APPARATUS FOR ELECTROMAGNETIC EXPOSURE OF PLANAR OR OTHER MATERIALS

BACKGROUND

The invention relates to electromagnetic energy, and more particularly, to electromagnetic exposure of planar materials.

Microwaves can be used to heat paper and other planar materials. It is well known in the art to use a slotted waveguide that has a serpentine path in order to maximize the exposure area of the material passed through the waveguide. See, for example, U.S. Pat. No. 5,169,571; U.S. Pat. No. 4,446,348; and U.S. Pat. No. 3,765,425. Conventional waveguides have four particular drawbacks. First, the microwave signal attenuates as it moves away from its source. This attenuation versus propagation distance increases when lossy planar materials are introduced into the waveguide. As a result, a material fed into the waveguide through a slot is heated more at one end of a segment (closer to a source) than at the other end (farther from a source). Prior art structures have not made use of the slot's orientation as a means for addressing this problem. In a traditional slotted waveguide, there is a field peak midway between two conducting surfaces. In the prior art, the slot is at this midway point. See, for example, U.S. Pat. No. 3,471,672, U.S. Pat. No. 3,765,425, and U.S. Pat. No. 5,169,571.

A second problem relates to the distribution of the microwave energy. Because the magnitude of the electric field in a microwave signal has peaks and valleys due to forward and reverse propagation in the waveguide, planar materials fed through a slotted waveguide tend to experience hot spots. U.S. Pat. No. 3,765,425 (hereinafter, "the '425 patent") addresses this problem through the use of two disconnected waveguides that are interspersed with each other. At least one waveguide is equipped with a phase shifter to ensure that the hot spots in one waveguide occur at locations different than in the other waveguide. One disadvantage to this approach (aside from the expense of a phase shifter) is that sections of separate waveguide must lay on top of one another in order for planar materials to experience alternating hot spots as they pass through the entire structure. Furthermore, each distinct variation in phase requires an additional serpentine waveguide and an additional microwave source.

Another attempt to smooth out the effect of "hot spots" is disclosed in U.S. Pat. No. 5,536,921 (hereinafter, "the '921 patent"). Like the '425 patent, the '921 patent also depends on separate and distinct sections of waveguide. However, instead of using one or more phase shifters, the '921 patent offsets its separated sections of waveguide by exactly a ¼ of a wavelength. One disadvantage of this approach is that it requires more than one phase-controlled path. The '921 patent requires even more paths than the '425 patent. According to the '921 disclosure, each waveguide section for exposing materials is a separate wave path. Each such section requires its own point for launching the wave and its own termination point. Each launching point inevitably has losses due to signal reflection.

In addition, the approach disclosed in the '921 patent does not allow for easy adjustment to adapt to a variety of materials. It will be appreciated by those skilled in the art that the actual length of a ¼ wavelength is dependent on the material introduced into the waveguide. Therefore, the '921 patent teaches a device that must be built for a specific material. If the constructed device was used for a material with a different $\epsilon_r$, the ¼ offset and its benefits would be reduced or completely eliminated. For example, if the structure disclosed in the '921 patent were used on a material whose $\epsilon_r$ was different by a factor of 4 from the $\epsilon_r$ of the material for which the structure was designed, then the material would be exposed to similarly placed (rather than offsetting) hot spots. It will also be appreciated by those skilled in the art that to further smooth out the effect of hot-spots, it may be advantageous to space hot spots by less than a ¼ of a wavelength. Applicants co-pending application #08/848,244, now U.S. Pat. No. 5,958,275, which is herein fully incorporated by reference, discloses an adjustable structure that can be used to heat a variety of materials.

Another attempt to smooth out the effect of "hot spots" is disclosed in U.S. Pat. No. 4,234,775 (hereinafter, "the '775 patent"). The '775 patent, like the '425 and '921 patents, uses a single frequency to try and uniformly heat a material. However, the '775 patent uses a tuning plunger, a rotating head, and a dielectric material to "substantially disrupt" the standing wave. One problem with this approach is that it is difficult to predict how the peaks and valleys will realign when the standing wave is disrupted. While purposely disrupting the standing wave shifts the peaks and valleys, it does not guarantee that the material is more evenly heated. It is important to note that because the '775 patent disrupts the wave, it is advantageous to place the rotating head at the end of the waveguide.

It will be appreciated by those skilled in the art that the distance between consecutive peaks depends on the frequency of the wave. If the frequency is increased, the distance between consecutive peaks decreases. If the frequency is decreased, the distance increases. Only recently, researchers have begun to realize that it is possible to vary the frequency of a wave in a multimode cavity to generate more uniform heating. See, for example, U.S. Pat. No. 5,879,756; U.S. Pat. No. 5,804,801; and U.S. Pat. No. 5,798,395. While researchers have experimented with using a variable frequency to generate a plurality of modes, Applicants are not aware of any references that teach how to use a variable frequency in a slotted waveguide to more uniformly heat a planar material.

A third problem with traditional waveguides for electromagnetic exposure relates to the field gradient between top and bottom conducting surfaces. This gradient does not pose a problem if the planar material is of an insignificant thickness. However, if the planar material does have an appreciable thickness, this gradient can lead to nonuniform heating. One way to overcome this problem is disclosed in Applicants' co-pending applications #08/813,061 and #08/848,244, now U.S. Pat. No. 5,998,774 and U.S. Pat. 5,958,275, respectively. These co-pending applications, which are herein fully incorporated by reference, disclose the advantages of a dielectric slab-loaded structure that elongates the peak field region in a single mode cavity. However, slab-loaded structures have not yet been adapted for exposure of planar materials.

A fourth problem relates to leakage of microwaves through the slot of a slotted waveguide. Energy leakage and radiation is a general problem for any microwave structure. The problem of radiation through open access points is magnified when the material being passed through the structure has any electrical conductivity. Such conductive substances (for example, any ionized moisture in paper that is passed through a chamber for drying) can, when passed through a microwave exposure structure, act as an antenna and carry microwaves outside the structure's cavity.

There are several different ways to address the problem of leakage through the slots of a slotted waveguide. One approach is to enclose the entire slotted waveguide in a reflective casing. See, for example, U.S. Pat. No. 5,169,571. This approach has obvious drawbacks. If the reflective casing does not itself have access points that remain open during the delivery of a microwave field, then the feed-through process must be fully automated and must exist inside the outer casing. On the other hand, if the reflective casing does have access points that remain open during the delivery of a microwave field—as does the structure disclosed in U.S. Pat. No. 5,169,571—then there is still a problem of leakage through those access points.

A second approach is the use of a reflective curtain or flap draped over the slot. U.S. Pat. No. 5,470,423 discloses such an approach. That patent discloses the use of conductive flaps or "fingers" (see "fingers 110" in FIG. 1). Although such a conductive curtain may reduce leakage, it may also tend to obstruct smooth passage of any material that is fed through the slot. Any contact between such a curtain and any material tends to disrupt the surface tension of the material. Moreover, damaging arcing may occur between the curtain and the material. Furthermore, a reflective curtain does nothing to reduce the problem of an electrically conductive material's tendency to act as an antenna—alone or in combination with a waveguide's exterior conducting surface—and thus radiate energy through the slot.

A third approach is the use of a choke flange. Chokes that prevent the escape of electromagnetic energy from the cracks between two imperfectly contacting surfaces are well known in the art. Particularly well known are chokes designed for microwave oven doors and waveguide couplers. See, for example, U.S. Reissue Pat. No. 32,664 (1988); U.S. Pat. No. 3,843,861. What has not been fully explored in the art is the use of the choke flange concept to reduce leakage through arbitrarily shaped access points that remain open during delivery of a microwave field. U.S. Pat. No. 4,999,469 (hereinafter, "the '469 patent") discloses a choke flange that can be used with a slotted waveguide. The '469 patent discloses a choke flange that has a vertical section that precedes a horizontal section. Although choke flanges have been used to reduce leakage through a continuously open opening, the present invention and co-pending applications #08/813,061 and #08/848,244, incorporated herein by reference, now U.S. Pat. No. 5,998,774 and U.S. Pat. No. 5,958,275, respectively, describe how the choke flange concept can be improved to decrease the amount of leakage. One problem with the choke flange in the '469 patent and some of the choke flanges disclosed in our earlier applications is that the choke flange can act as an antenna radiating the energy that travels along it.

SUMMARY

The present invention overcomes many of the problems associated with electromagnetic exposure of planar materials. According to one aspect of the invention, a source provides an electromagnetic wave that has a range of frequencies. The source sweeps the frequency of the electromagnetic wave between a cutoff frequency and double the cutoff frequency.

According to another aspect of the invention, the location, angle, or effective angle of an opening is adjusted by an opening adjuster.

According to another aspect of the invention, a path for an electromagnetic wave has a short for creating a standing wave. The path has a movable surface that can push and pull the peaks and valleys of the standing wave so as to achieve more uniform heating of the material.

According to another aspect of the invention, a dielectric wheel pushes and pulls the peaks and valleys of a standing wave so as to achieve more uniform heating of a material.

According to another aspect of the invention, a dielectric structure pushes and pulls the peaks and valleys of a standing wave so as to achieve more uniform heating of a material.

According to another aspect of the invention, the dielectric structure has a surface with a long side and a short side, and the dielectric structure is rotated about an axis parallel to the short side so that when the dielectric structure is in a first position, the long side of the surface is parallel to a short side of the waveguide, and when the dielectric structure is in a second position, the long side of the surface is perpendicular to the short side of the waveguide.

According to another aspect of the invention, the dielectric structure has a surface with a long side and a short side, and the dielectric structure is rotated about an axis parallel to the long side so that when the dielectric structure is in a first position, the short side of the surface is perpendicular to a long side of the path, and when the dielectric structure is in a second position, the short side of the surface is parallel to the long side of the waveguide.

According to another aspect of the invention, the dielectric structure has a surface with a long side and a short side, and the dielectric structure is rotated about an axis parallel to the long side so that when the dielectric structure is in a first position, the short side of the surface is perpendicular to a long side of the waveguide, and when the dielectric structure is in a second position, the short side of the surface is parallel to the long side of the waveguide.

According to another aspect of the invention, a path has a first choke flange that has a width $w_1$, and a second choke flange that has a width $w_2$. The widths $w_1$ and $w_2$ are selected to minimize the escape of electromagnetic energy from the path.

According to another aspect of the invention, a path has a first choke flange that has a height $h_1$ and a second choke flange that has a height $h_2$. The heights $h_1$ and $h_2$ are selected to minimize the escape of electromagnetic energy from the path.

According to another aspect of the invention, a choke flange has gaps to prevent the flow of electromagnetic energy along the choke flange.

According to another aspect of the invention, a choke flange has a horizontal section and a vertical section. The horizontal section has a narrow dimension to limit the escape of electromagnetic energy from the interior region. The vertical section is located at an end of the horizontal section opposite the opening.

An advantage of the invention is that it is possible to heat different materials without adjusting the path length of the electromagnetic wave. Another advantage of the invention is that it is possible to heat different materials and still benefit from a diagonal slot. Another advantage of the invention is that is possible to increase or decrease the amount of heating and/or efficiently heat materials with different degrees of lossiness. Another advantage of the invention is that it is possible to minimize the amount of electromagnetic energy that escapes through the opening. Another advantage of the invention is that it is possible to uniformly heat different materials without adjusting the path or sweeping the frequency.

Another advantage of the invention is that it is possible to heat different materials by placing a dielectric wheel or structure anywhere along the path. Another advantage of the invention is that when the dielectric structure is contained by the path additional choke flanges are not needed.

BRIEF DESCRIPTION OF THE DRAWINGS

The foregoing, and other objects, features, and advantages of the invention will be more readily understood upon reading the following detailed description in conjunction with the drawings in which:

FIGS. 9*a*, 9*b*, 9*c*, 9*d*, and 9*e* are illustrations of various openings and choke flanges in accordance with the present invention;

DETAILED DESCRIPTION

In the following description, specific details are discussed in order to provide a better understanding of the invention. However, it will be apparent to those skilled in the art that the invention can be practiced in other embodiments that depart from these specific details. In other instances, detailed descriptions of well-known methods and circuits are omitted so as to not obscure the description of the invention with unnecessary detail.

Figure 1:
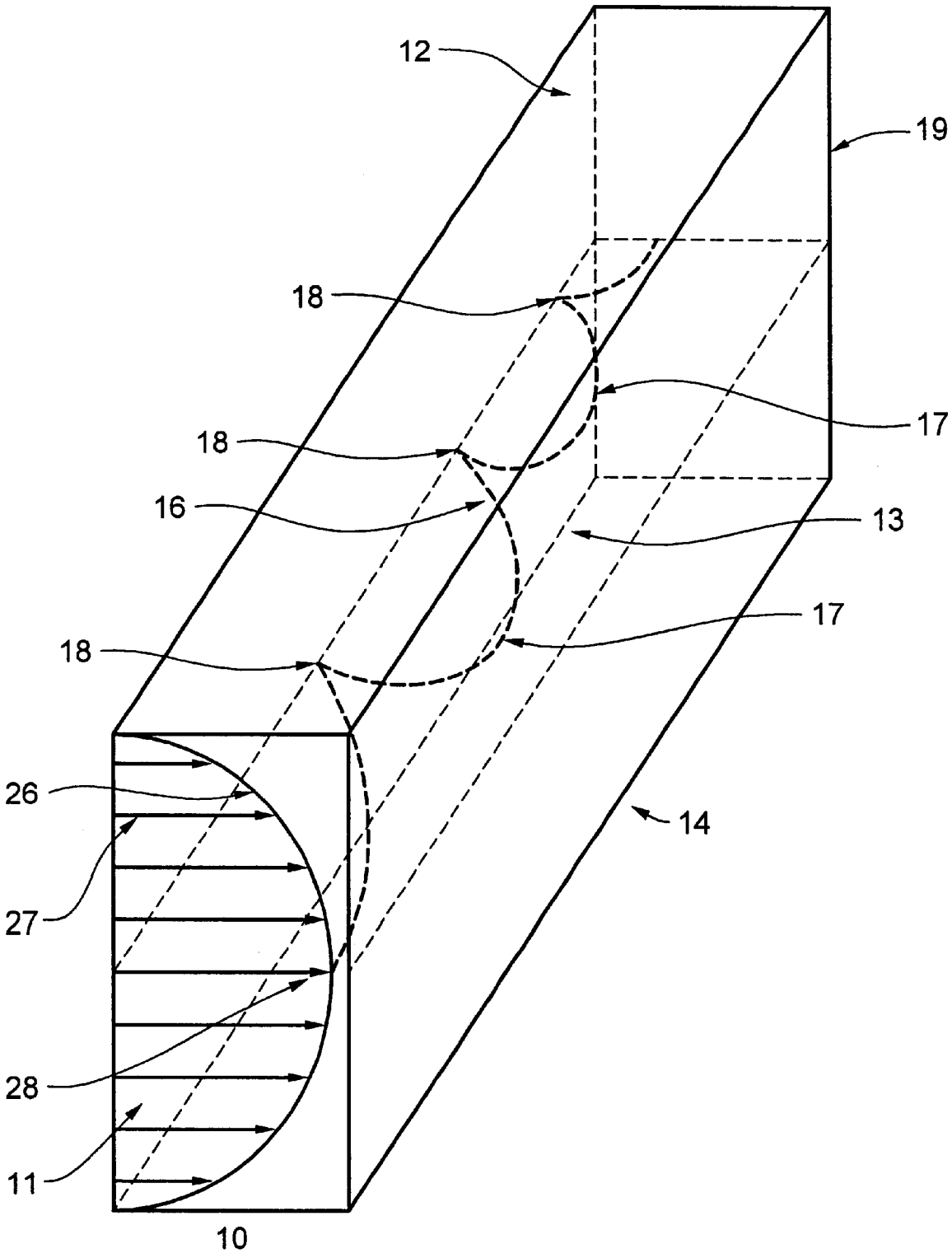
FIG. 1 is an illustration of a path for an electromagnetic wave.

Referring now to the drawings, FIG. 1 is an illustration of a path 10 for an electromagnetic wave 16. It is important to note that the term "path" refers to any space in which an electromagnetic wave may exist, and in some contexts can be used interchangeably with the term "chamber." The path 10 has a top conducting surface 12 and a bottom conducting surface 14. The conducting surfaces 12 and 14 can be a continuous surface or a perforated surface. Perforated surfaces enhance evaporation and/or allow moisture to drain through the bottom surface 14.

If an electromagnetic wave source (not shown) is attached to a first end 11 of the path 10, an electromagnetic wave 16 propagates towards the second end 19. The number of peaks 17 and the number of valleys 18 are a function of the length of the path 10, the frequency of the electromagnetic wave 16, and the dielectric constant of materials within the interior cavity 13. It will be appreciated by those skilled in the art that when lossy materials are introduced into cavity 13, the magnitude of the peaks 17 decays exponentially as a function of the distance from the source (not shown) of the electromagnetic wave 16.

The electromagnetic wave 16 creates an electric field 26 between the top conducting surface 12 and the bottom conducting surface 14. The electric field 26 has a magnitude indicated by the horizontal arrows 27. The electric field 26 has a peak magnitude 28 at a point midway between the top conducting surface 12 and the bottom conducting surface 14 when the path 10 is operating in the lowest order mode of the waveguide ($TE_{10}$).

If the second end 19 has a matched load, electromagnetic wave 16 is a traveling wave, and if all other factors are held constant, the location of the peaks 17 and the location of the valleys 18 will move along path 10 from first end 11 to second end 19. One problem with using a load is that the load may absorb a significant portion of the electromagnetic energy. If the second end 19 has a short, electromagnetic wave 16 is a standing wave, and if all other factors are held constant, the location of the peaks 17 and the location of the valleys 18 are stationary.

The source (not shown) can generate a single frequency or a plurality of frequencies. In the later case, the source can "sweep" a range of frequencies. The source can adjust the range of frequencies and the rate at which the frequencies are swept. If the wave is a traveling wave, the sweeping can be used to increase or decrease the rate at which the peaks and valleys propagate along the path. If the wave is a standing wave, the sweeping can be used to move the peaks and valleys so as to prevent the formation of hot and cold spots along the path. If the source sweeps a large range of frequencies, it may be more advantageous to use a short and a standing wave. If the source sweeps a small range of frequencies to merely prevent arcing, it may be more advantageous to use a matched load and a traveling wave.

Figure 2:
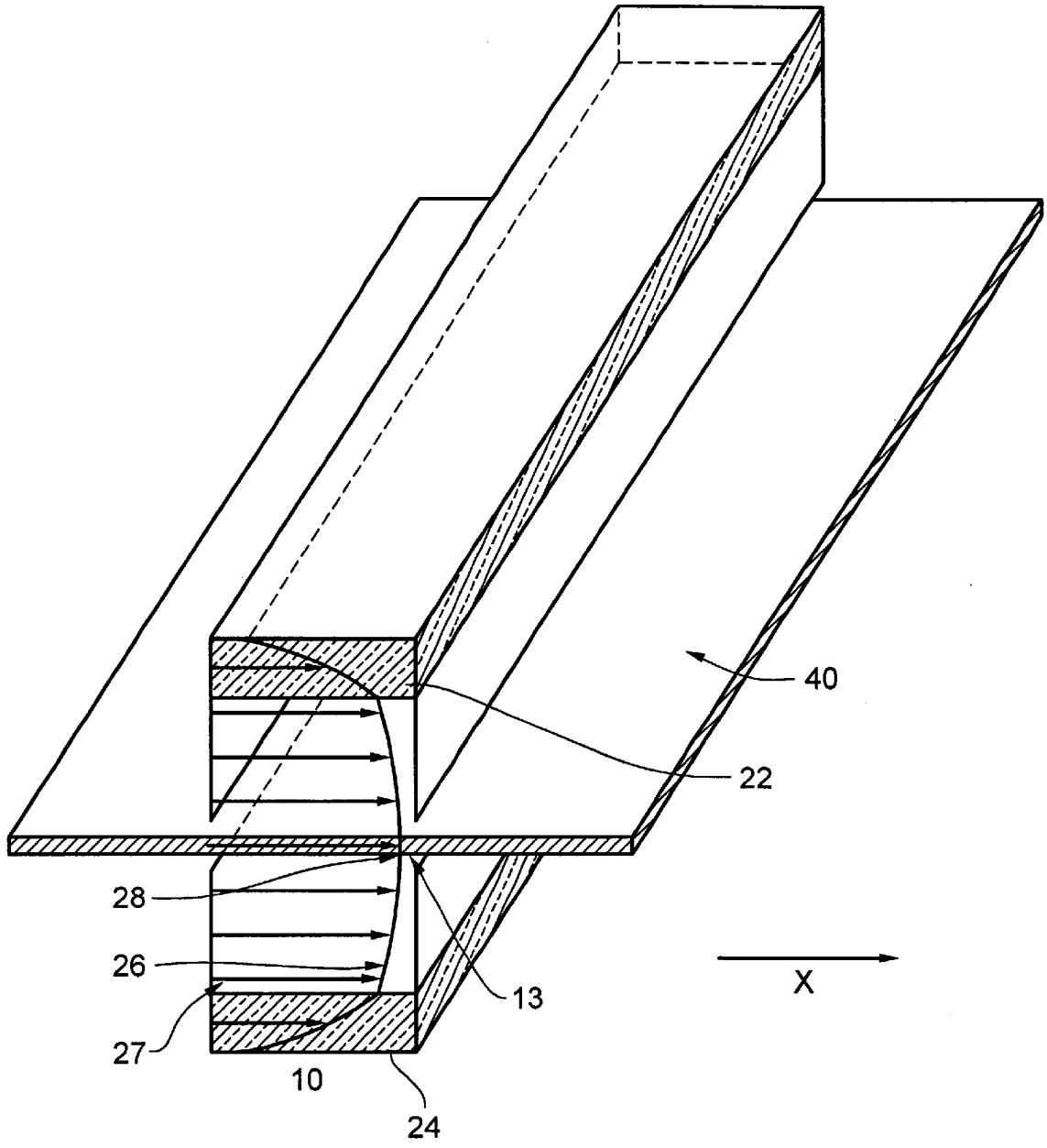
FIG. 2 is an illustration of a path for electromagnetic exposure of a planar material.

FIG. 2 is an illustration of a path for electromagnetic exposure of a planar material. As disclosed in co-pending application #08/813,061, dielectric slabs 22 and 24 create a more uniform electric field 26 in cavity 13. That is, the magnitude 27 at the top or the bottom edge of cavity 13 is closer in value to the peak value 28. Dielectric slabs 22 and 24 may be a ¼ of a wavelength of an electromagnetic field in the slab material. However, because the material passed through cavity 13 may be much thinner than the spacing between the top and bottom edge of cavity 13, dielectric slabs 22 and 24 will enhance exposure uniformity across the material's thickness even if the dielectric slabs 22 and 24 are not ¼ of a wavelength.

Figure 3:
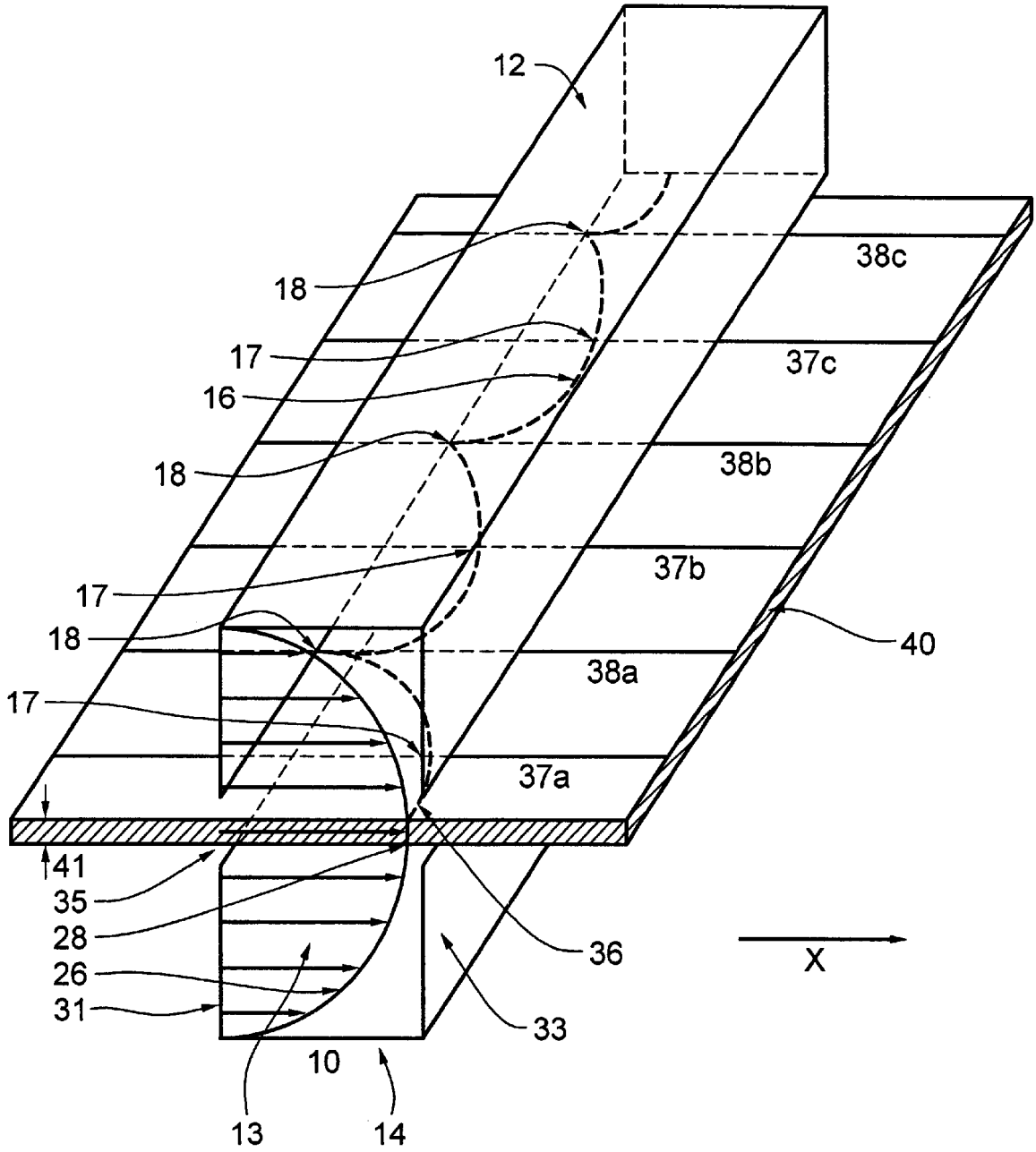
FIG. 3 is an illustration of a path for electromagnetic exposure of a planar material.

FIG. 3 is an illustration of a path for electromagnetic exposure of a planar material. Material 40 is a planar material. A planar material is any material or arrangement of materials that has a length and width that exceeds its thickness. While the disclosed invention is particularly suited for heating materials such as paper or fiberboard, it is equally useful for heating potato chips, tobacco leaves, or electronic devices. It will be recognized by those skilled in the art that any non-planar material can be loaded or delivered by a tray, conveyor belt, or other means whereby the entire arrangement of items may have the characteristics of a planar material.

Exposure segment 10 has a first conducting side 31 and a second conducting side 33. At least one of the sides 31 or 33 has an opening 35. Opening 35 can be of any shape, and run any or all of the length of exposure segment 10. If the second side 33 has a second opening 36, then the planar material 40 can pass completely through the interior cavity 13 of segment 10 in direction x.

Opening 36 needs to be thick enough to allow the planar material to pass through the second side 33. However, as the thickness of opening 36 increases, the amount of electromagnetic energy that can escape through opening 36 tends to increase. Therefore, in order to minimize leakage, the optimum thickness of opening 36 will depend on the thickness 41 of the planar material 40.

It will be appreciated by those skilled in the art that if the thickness of the planar material 40 is small relative to the distance between the top conductive surface 12 and the bottom conductive surface 14, then all of the planar material 40 is exposed to a magnitude that is close to the peak 28 of the electric field 26.

However, if the thickness of the planar material 40 is large relative to the distance between the top conductive surface 12 and the bottom conductive surface 14, then the top and bottom edges of the planar material 40 are exposed to magnitudes that are less than the peak 28. Therefore, the use of dielectric slabs becomes increasingly important as the thickness 41 of the planar material increases.

Regardless of the thickness of the planar material 40, if the opening 36 is at a point midway between the top conducting surface 12 and the bottom conducting surface 14, then the planar material 40 is exposed to the peak 28 of the electric field 26. If the opening 36 is not at a point midway between the top conducting surface 12 and the bottom conducting surface 14, then the planar material 40 is exposed at least in part to a magnitude that is less than peak 28.

Assuming that the first end 11 of the segment 30 is closer to the source (not shown) of the electromagnetic wave 16, then the exposure along 37*c* is equal to or less than the exposure along line 37*a*. Even though the planar material 40 along line 37*c* is exposed to a peak 17 of the electromagnetic wave 16, the exposure along line 37*c* may, due to attenuation, be less than along lines corresponding to previous peaks.

Figure 4A:
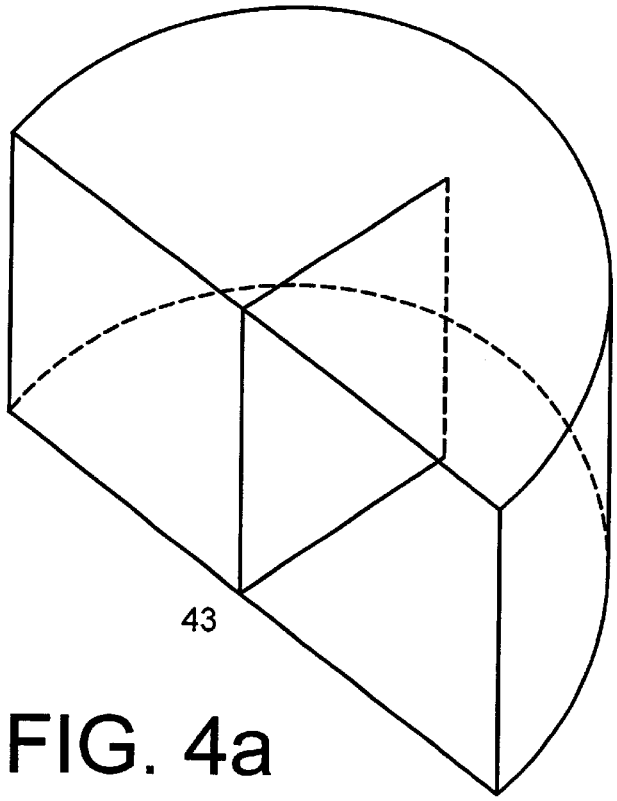
FIGS. 4*a* and 4*b* are illustrations of curved segments.
Figure 4B:
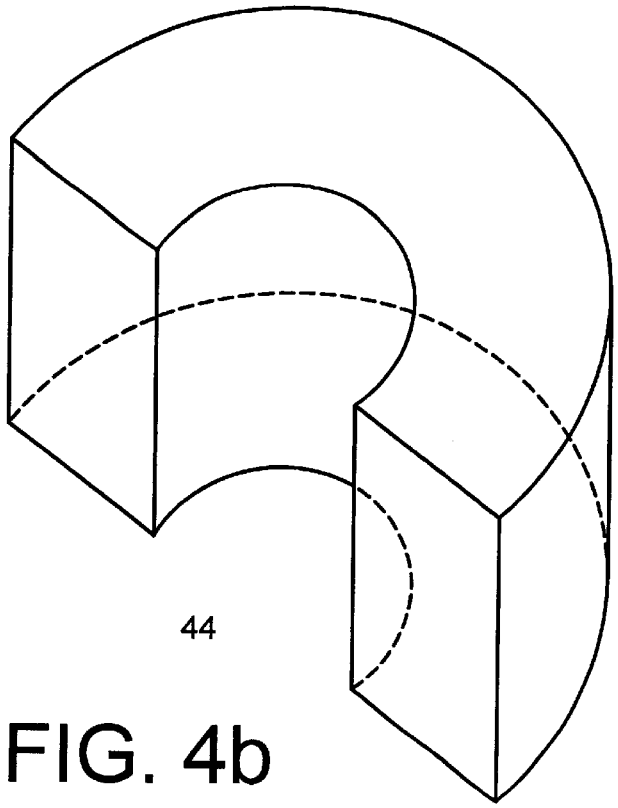

FIG. 4*a* illustrates a curved segment 43. FIG. 4*b* illustrates another curved segment 44. One or more curved segments 43 or 44 may be used to connect two or more exposure segments. Curved segments act as an extension of path 10 for electromagnetic wave 16. Thus, adjusting the length of a curved segment 43 or 44 affects the overall length of the wave's path. It will be appreciated by those skilled in the art that curved segment 44 is necessary if the exposure segments are spaced apart.

Figure 5A:
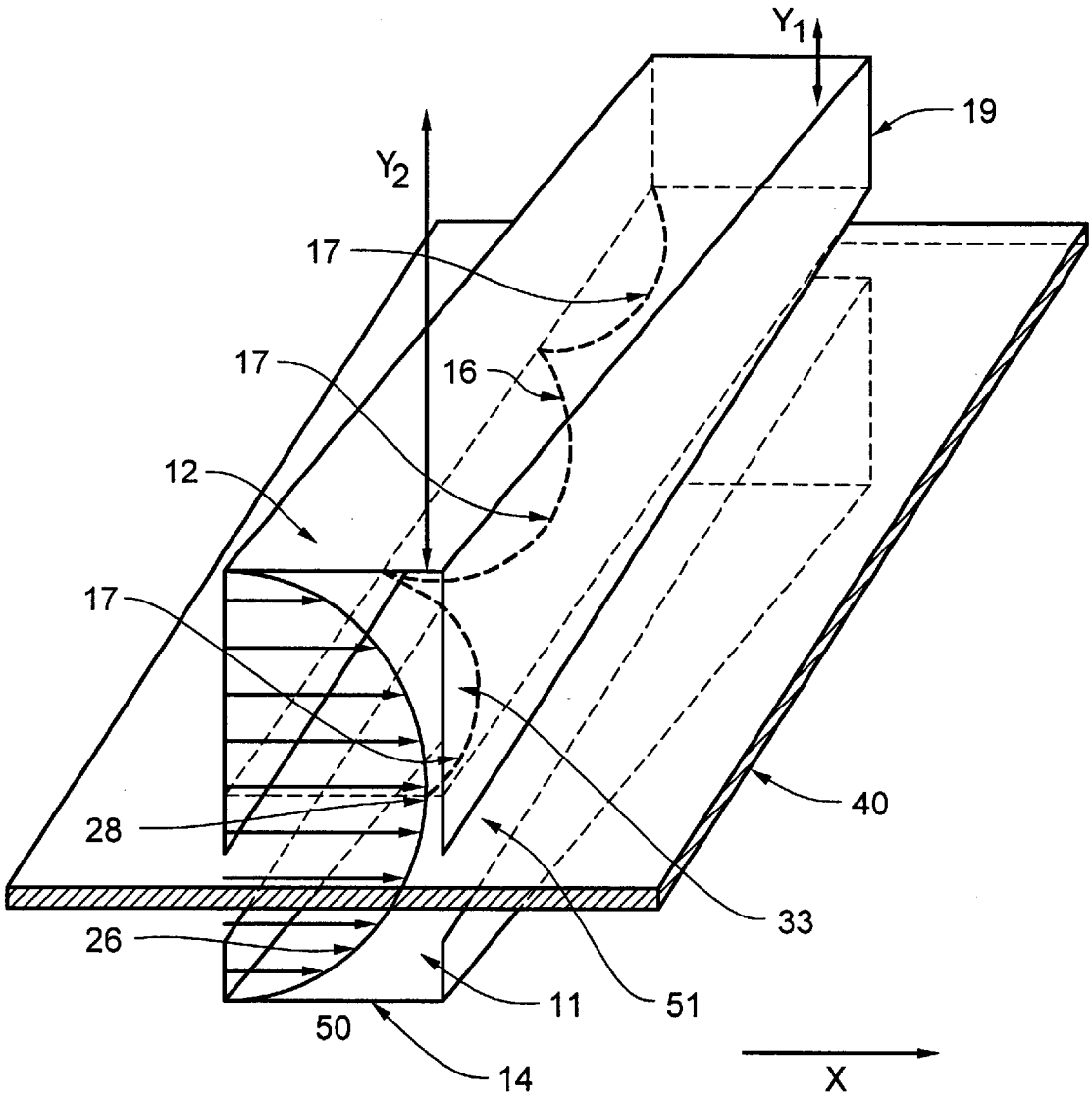
FIGS. 5*a*, 5*b*, 5*c*, 5*d*, and 5*e* are illustrations of paths that compensate for attenuation of an electromagnetic wave.

FIG. 5*a* is an illustration of a path that compensates for attenuation of electromagnetic wave 16. Exposure segment 50 has a diagonal opening 51. It is important to note that opening 51 is diagonal relative to side 33 of exposure segment 50, but opening 51 may or may not be parallel to a floor of a room (not shown). The value of a diagonal opening 51 is that it promotes more even heating by setting two different variations in electromagnetic exposure against each other. The first variation is between the top and bottom conducting surface of an exposure segment. This is illustrated in FIG. 5*a* by the shape of electric field 26. Electromagnetic exposure in a given cross section of segment 50 is less near top and bottom conducting surfaces 12 and 14 than it is near a midway point between surfaces 12 and 14.

The second variation in electromagnetic exposure is between an end of the waveguide nearer the source and an end of a waveguide farther from the source. This variation occurs when the planar material 40 is lossy. This variation is illustrated in FIG. 5*a* by the attenuated peaks 17 of electromagnetic wave 16. At end 11, nearer the source (not shown), peaks 17 are higher than they are at end 19.

Diagonal opening 51 sets these two variations against each other in the following manner: Assuming end 11 is nearer the source (not shown), the material 40 is introduced through an opening 51 that is further from peak 28 at end 11 than at end 19. In other words, where material 40 is nearer the source (not shown) it should be farther from peak 28; where material 40 is farther from the source (not shown) it should be closer to peak 28.

If the material is relatively lossy, the angle of diagonal opening 51 should be increased. If the material is relatively lossless, the angle of diagonal opening 51 should be decreased. If exposure segment 50 is built for heating a particular material with a particular degree of lossiness, it is not necessary to adjust the angle of diagonal opening 51. If exposure segment 50 is built for heating different materials with different degrees of lossiness, it may be advantageous to adjust the angle or effective angle of diagonal opening 51. There are several ways to adjust the angle or effective angle of diagonal opening 51. One way is to add a pivot point so that the top half of exposure segment 50 can move up or down like the top half of a stapler. Another way is to use a collapsible floor in the bottom of exposure segment 50. Another way is to use a dielectric insert that shifts the location of peak 28.

In FIG. 5*a*, if the end closer to the source is moved up a distance $y_2$, and the end farther from the source is moved up a distance $y_1$, where $y_2$ is greater than $y_1$, it is possible to increase the effective angle of diagonal opening 51 so as to account for a material that is more lossy. Moving end 11 up a distance $y_2$ elongates the electric field 26 at end 11. As a result, material 40 is exposed to a more off-peak region of electric field 26 at end 11. If end 19 is held constant or nearly constant, the electric field 26 at the second end 19 remains the same or nearly the same, and material 40 is exposed to a region at or near the peak of electric field 26 at end 19. Because material 40 is exposed to an even more off-peak region at end 11 and relatively the same region at end 19, the path provides increased compensation for the increased attenuation of electromagnetic wave 16.

In FIG. 5*a*, if the end closer to the source is moved down a distance $y_2$ and the end farther from the source is moved down a distance $y_1$, where $y_2$ is greater than $y_1$, it is possible to decrease the effective angle of diagonal opening 51 so as to account for a material that is less lossy. Moving end 11 down a distance $y_2$ compresses the electric field 26 at end 11. As a result, material 40 is exposed to a less off-peak region of electric field 26 at end 11. If end 19 is held constant or nearly constant, the electric field 26 at the second end 19 remains the same or nearly the same, and material 40 is exposed to a region at or near the peak of electric field 26 at end 19. Because material 40 is exposed to a less off-peak region at end 11 and relatively the same region at end 19, the path provides decreased compensation for the decreased attenuation of electromagnetic wave 16.

In FIG. 5*a*, if the end closer to the source is moved up a distance $y_2$ and the end further from the source is moved up a distance $y_1$, where $y_2$ is equal to $y_1$, it is possible to decrease the amount of heating along the path. Moving end 11 up a distance $y_2$ elongates the electric field 26 at end 11. As a result, material 40 is exposed to a more off-peak region of electric field 26 at end 11. Moving end 19 up a distance $y_1$ elongates the electric field at end 19. As a result, material 40 is exposed to a more off-peak region of electric field 26 at end 19. Because material 40 is exposed to a more off-peak region at end 11 and a more off-peak region at end 19, the path provides decreased heating.

In FIG. 5*a*, if the end closer to the source is moved down a distance $y_2$ and the end farther from the source is moved down a distance $y_1$, where $y_2$ is equal to $y_1$, it is possible to increase the amount of heating along the path. Moving end 11 down a distance $y_2$ compresses the electric field 26 at end 11. As a result, material 40 is exposed to a less off-peak region of electric field 26 at end 11. Moving end 19 down a distance $y_1$ compresses the electric field 26 at end 19. As a result, material 40 is exposed to a less off-peak region of electric field 26 at end 19. Because material 40 is exposed to a less off-peak region at end 11 and a less off-peak region at end 19, the path provides increased heating. It will be appreciated by those skilled in the art that if the opening at end 19 is already located at or near the peak of the electric field 26 at end 19, moving end 19 down a distance $y_1$ may mean that the opening at end 19 is moved from a peak region of electric field 26 to an off-peak region of electric field 26. If this is the case, the opening may actually go from a first off-peak region through the peak region to a second off-peak region. In some applications, it may be advantageous to heat an edge of material 40 at end 19 less than the rest of material 40.

Referring back to FIG. 3, if the end closer to the source is moved up a distance $y_2$, and the end farther from the source is moved up a distance $y_1$, where $y_2$ is greater than $y_1$, it is possible to increase the effective angle of opening 36. Moving end 11 up a distance $y_2$ elongates the electric field 26 at end 11. As a result, material 40 is exposed to a more off-peak region of electric field 26 at end 11. If end 19 is held constant or nearly constant, the electric field 26 at the second end 19 remains the same or nearly the same, and material 40 is exposed to a region at or near the peak of electric field 26 at end 19. Because material 40 is exposed to an off-peak region at end 11 and relatively the same region at end 19, the path provides increased compensation for attenuation of electromagnetic wave 16.

Referring back to FIG. 3, if the end closer to the source is moved up a distance $y_2$ and the end farther from the source is moved up a distance $y_1$, where $y_2$ is equal to $y_1$, it is possible to decrease the amount of heating along the path. Moving end 11 up a distance $y_2$ elongates the electric field 26 at end 11. As a result, material 40 is exposed to an off-peak region of electric field 26 at end 11. Moving end 19 up a distance $y_1$ elongates the electric field 26 at end 19. As a result, material 40 is exposed to an off-peak region at end 19. Because material 40 is exposed to an off-peak region at end 11 and an off-peak region at end 19, the path provides decreased heating.

Figure 5B:
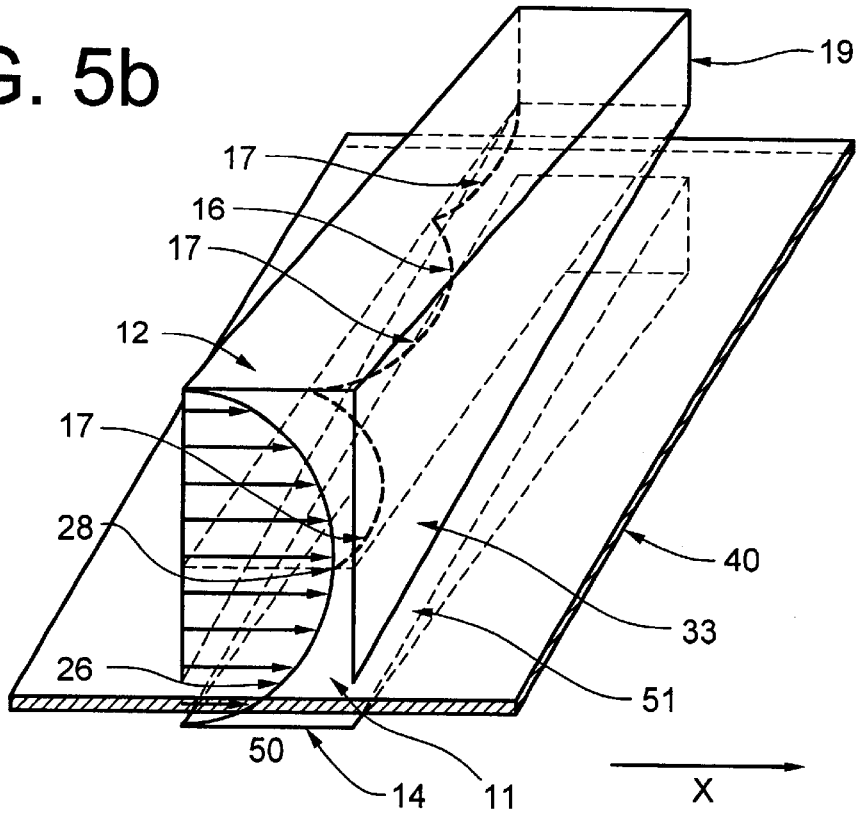
Figure 5C:
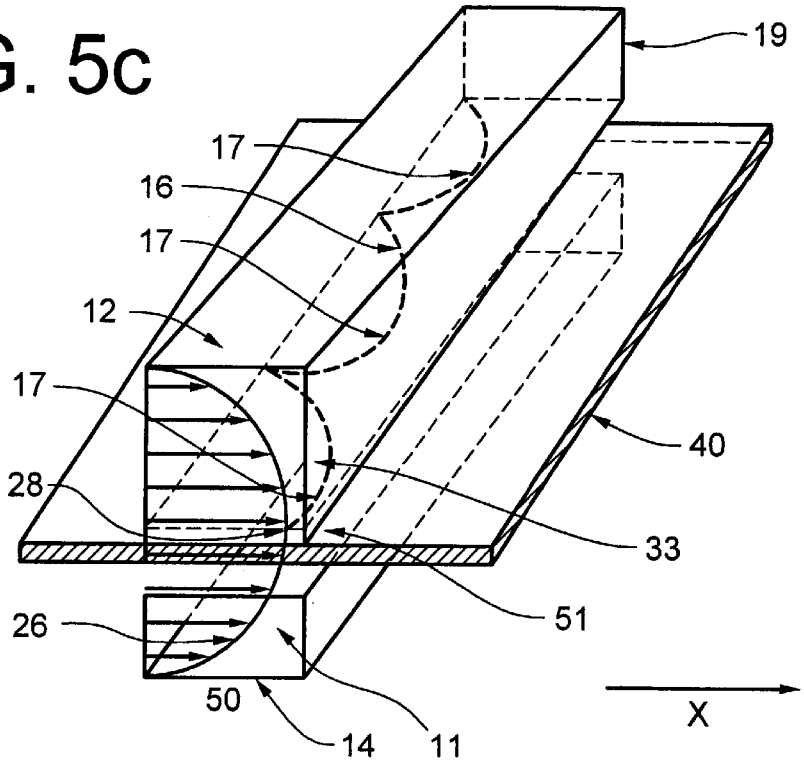
Figure 5D:
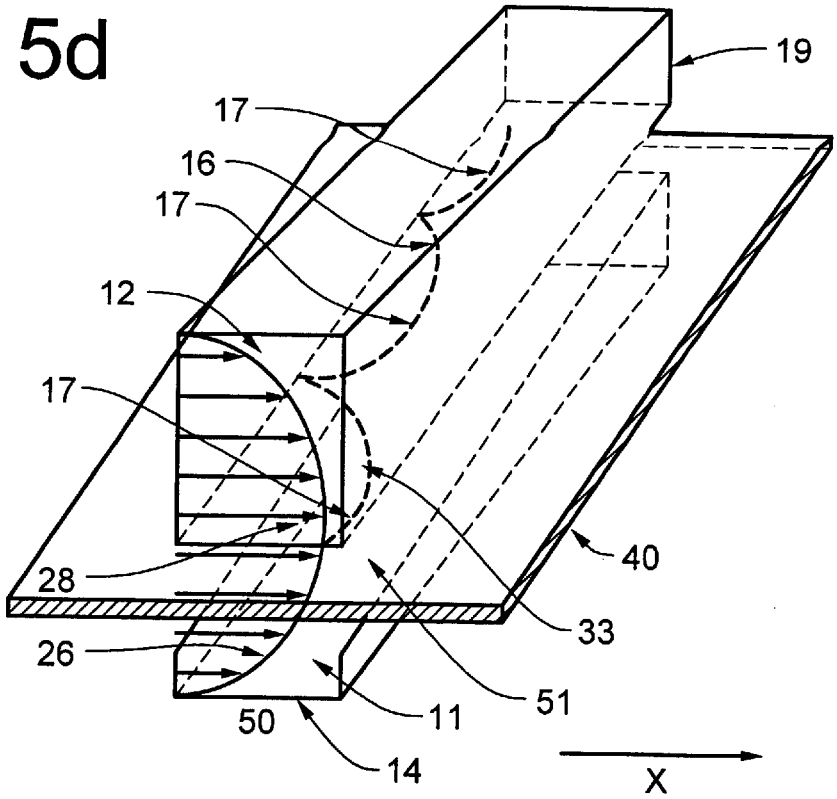
Figure 5E:
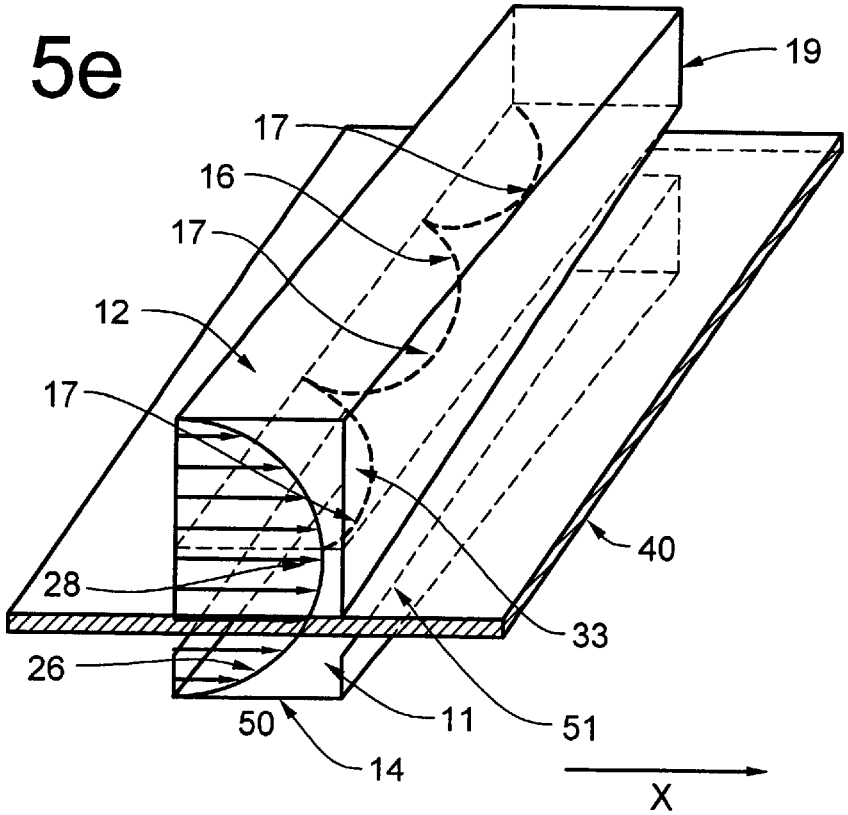

FIG. 5*b* is an illustration of an exposure segment in a first position for electromagnetic exposure of a more lossy material. FIG. 5*c* is an illustration of an exposure segment in a second position for electromagetic exposure of a less lossy material. Similarly, FIG. 5*d* is an illustration of an exposure segment in a first position for electromagnetic exposure of a more lossy material. FIG. 5*e* is an illustration of an exposure segment in a first position for electromagnetic exposure of a less lossy material.

In FIG. 5*b*, the angle of diagonal opening 51 has been increased. As a result, material 40 is exposed to a magnitude of electromagnetic wave 26 at end 11 that is farther from peak 28 than in FIG. 5*c*. If material 40 is a more lossy material, the increased angle is useful to achieve more uniform heating from end 11 to end 19.

In FIG. 5*c*, the angle of diagonal opening 51 has been decreased. As a result, material 40 is exposed to a magnitude of electromagnetic wave 26 at end 11 that is closer to peak 28 than in FIG. 5*b*. If material 40 is a less lossy material, the decreased angle is useful to achieve more uniform heating from end 11 to end 19.

In FIG. 5*d*, the effective angle of diagonal opening 51 has been increased. When the top half of the waveguide is moved upwardly at end 11, the peak 28 is also moved upwardly at end 11. As a result, material 40 is exposed to a magnitude of electromagnetic wave 26 at end 11 that is farther from peak 28 than in FIG. 5*e*. If material 40 is a more lossy material, the increased effective angle is useful to achieve more uniform heating from end 11 to end 19.

In FIG. 5*e*, the effective angle of diagonal opening 51 has been decreased. When the top half of the waveguide is move downwardly at end 11, the peak 28 is also moved downwardly at end 11. As a result, material 40 is exposed to a magnitude of electromagnetic wave 26 at end 11 that is closer to peak 28 than in FIG. 5*d*. If material 40 is a less lossy material, the decreased effective angle is useful to achieve more uniform heating from end 11 to end 19.

If the source (not shown) is a swept frequency source, benefits of a diagonal slot can still be realized, particularly if the frequency sweep is such the electromagnetic wave is maintained in the lowest order mode ($TE_{10}$). This may be accomplished by sweeping the frequency somewhere between the range of no less than $f_c$ and slightly less than $2f_c$ where $f_c$ is the cutoff frequency of the path, that is, the lowest frequency that will propagate in the path. Although the diagonal slot may still provide benefits at frequencies greater than $2f_c$, the greatest benefits occur if operation is maintained in the $TE_{10}$ mode.

Figure 6:
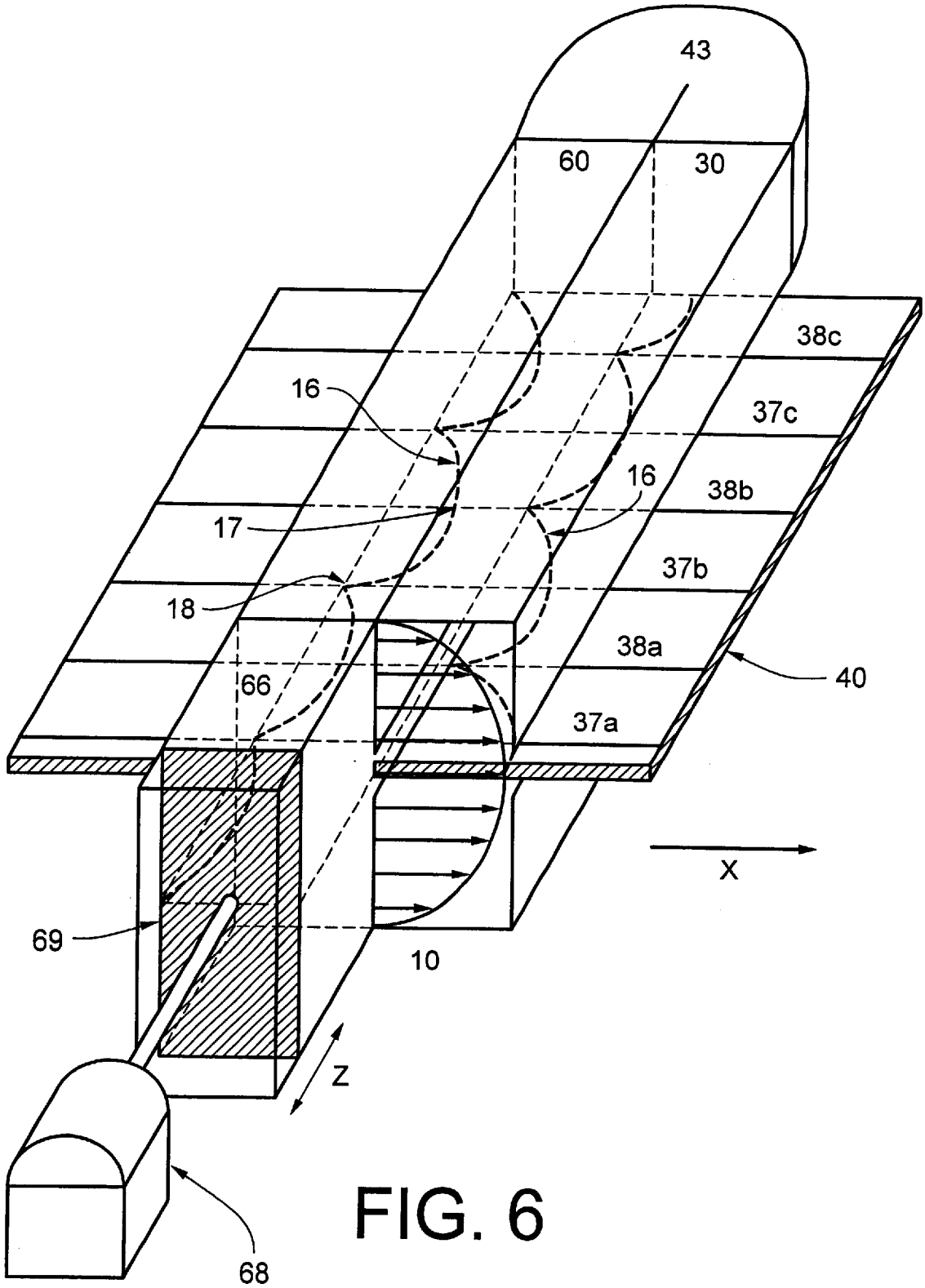
FIG. 6 is an illustration of a movable surface that can push and pull the peaks and valleys of a standing wave.

FIG. 6 is an illustration of a movable surface that can push and pull the peaks and valleys of a standing wave. Curved segment 43 connects exposure segment 30 and exposure segment 60. The length of exposure segment 43 is defined by the length of the portion of path 10 (of which segment 43 is a part) between exposure segment 30 and exposure segment 43. The exposure segment 60 connects to a termination segment 66 that has a terminating point 69. The length of segment 66 is defined as the length of the portion of path 10 (of which segment 66 is a part) between point 69 and segment 60. The length of segment 60 may be zero units (point 69 right at end of segment 60) or greater than zero units.

In exposure segment 30, planar material 40 is exposed to an electromagnetic wave 16. Electromagnetic wave 16 has peaks 17 and valleys 18. If point 69 is a short circuit, electromagnetic wave 16 is a standing wave and the locations of the peaks 17 and the valleys 18 are stationary. In this case, as material 40 passes through segment 30, it is exposed to peaks 17 in the electromagnetic wave 16 along a given set of lines 37*a*, 37*b*, and 37*c*; also as it passes through segment 30, planar material 40 is exposed to valleys 18 along another given set of lines 38*a*, 38*b*, and 38*c*. These alternating peaks 17 and valleys 18 of the electromagnetic wave 16 in segment 30 tend to create hot spots along lines 37 of planar material 40 and cold spots along lines 38 of planar material 40.

Material 40 may be heated more uniformly by offsetting the exposure peaks in segment 30 with exposure valleys in segment 60 and, correspondingly, offsetting the exposure valleys in segment 30 with exposure peaks in segment 60. In other words, along lines 37, the planar material should be exposed to peaks in segment 30 and valleys in segment 60; and along lines 38 the planar material should be exposed to valleys in segment 30 and peaks in segment 60. This may be accomplished by recognizing that the location of peaks and valleys in segment 30 relative to the location of peaks and valleys in segment 60 is a function of the combined length of segments 30, 43, 60 and 66.

The exact combined length of segments 30, 43, 60, and 66 that will produce the offsetting peaks and valleys just described will depend on both the type of point in termination segment 66 and the properties of planar material 40. In order to make the embodiment illustrated in FIG. 6 easily adaptable to variations in the properties of planar material 40, two alternatives are suggested.

First, if segment 66 is to terminate in a short circuit, methods well known in the art may be employed to make the location of the short readily adjustable. For example, load 69 may be a slidable conducting plate. If the length of segment 66 is defined as the distance between conducting plate 69 and segment 60, then the length of segment 66 may be adjusted by simply sliding the conducting plate 69. It will be appreciated by those skilled in the art that the boundary condition at a short circuit means that wave 16 will have a valley at plate 69. It will be further appreciated that as plate 69 slides either towards segment 60 or away from segment 60, the standing wave 16, along with its peaks 17 and valleys 18, will be in a sense "pulled" or "pushed" along segments 66, 60, 43, and 30.

An analogy may be made to a rope on a pulley where the rope has a series of knots. If wave 16 is the rope, peaks 17 are the knots, plate 69 is an anchor point, and segment 43 is the pulley, then, by analogy, the knots (peaks) on one side of the pulley (the wave peaks in segment 30) may be aligned to offset the knots on the other side of the pulley (the wave peaks in segment 60) by simply pulling or pushing the rope (wave 16) around the pulley (segment 43) by moving its anchor point (adjusting the location of plate 69).

A second alternative for adjusting the combined length of segments 30, 43, 60, and 66 is to make the length of segment 43 readily adjustable. This may be accomplished by making segment 43 readily replaceable with longer length segments. It may also be accomplished by connecting segment 43 to segments 30 and 60 in such a way that segment 43 may slide into segments 30 and 60, just as a slide on a trombone makes the effective length of the trombone's airway readily adjustable. The effect of adjusting the length of segment 43 may be visualized by retuning to the rope/pulley analogy. In this case, electromagnetic source (not shown) may be compared to a feed point or spool of rope and the load 69 may again be compared to a point to which the rope is anchored. Segment 43 is again the pulley. Increasing the length of segment 43 is analogous to raising the height of the pulley. If the rope (wave 16) is anchored at a point (plate 69), then, as the pulley is raised (segment 43 is lengthened), rope (wave 16) will feed from the spool (electromagnetic source, not shown), and the position of knots on one side of the pulley (position of peaks 17 in segment 30) will adjust relative to the position of knots on the other side of the pulley (position of peaks 17 in segment 60).

If the combined length of segments 30, 43, 60, and 66 is made adjustable in either of the ways described above, then one skilled in the art may adapt the present invention for use with a variety of planar materials without undue experimentation.

In some applications, it may be desirable to minimize the need for having to make structural adjustments in order to adapt to different material properties. As mentioned above, it is possible to use a traveling wave. If the short at the end of the waveguide is replaced with a matched load, the peaks and valleys propagate along the path. It is possible, however, to use a standing wave and continuously change the combined length (or effective length) of segments 30, 43, 60, and 66 to push and pull the peaks and valleys of the standing wave. There are several ways to continuously change the combined length of segments 30, 43, 60, and 66. One way is to attach a motor 68 to a movable plate 69. As plate 69 slides either towards segment 60 or away from segment 60, the peaks 17 and valleys 18 of standing wave 16 are pushed and pulled along segments 66, 60, 43, and 30. If plate 69 is moved back and forth at a rate significantly faster than the rate at which that planar material 40 moves in direction x, it is possible to effectively smooth the hot spots in cavities 30 and 60 without having to use a traveling wave.

Figure 7:
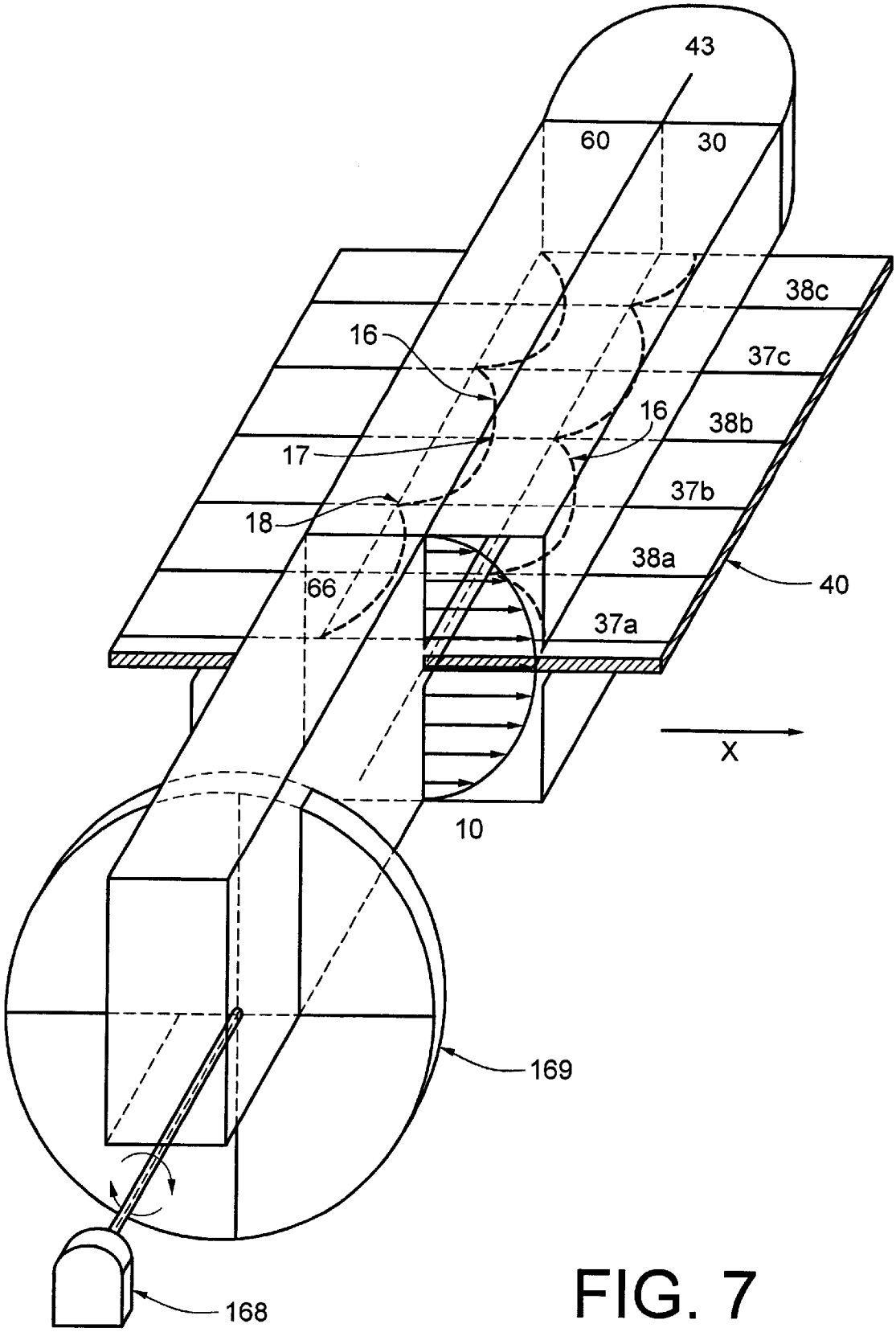
FIG. 7 is an illustration of a movable surface that can push and pull the peaks and valleys of a standing wave.

FIG. 7 is an illustration of a movable surface that can push and pull the peaks and valleys of a standing wave. A motor 168 is attached to the center of a dielectric wheel 169. The motor 168 rotates dielectric wheel 169 so that dielectric wheel 169 acts like a variable phase shifter continuously changing the effective length of segments 30, 43, 60, and 66. If dielectric wheel passes outside of segment 66, choke flanges can be used to prevent leakage through any openings in section 66.

Dielectric wheel 169 can be constructed of a single material with varying thicknesses. For example, dielectric wheel 169 might have an edge that adds one half of a wavelength or a nominal amount of a wavelength to the effective length of segments 30, 43, 60, and 66 and a second edge that adds one quarter of a wavelength to the effective length of segments 30, 43, 60, and 66. The thickness of the two edges depends on the dielectric constant of the dielectric wheel and the amount of dielectric that is displaced. One relatively easy way to construct dielectric wheel 169 is to obtain a dielectric cylinder that has a height slightly greater than one quarter of a wavelength of the electromagnetic wave in the cylinder. If the cylinder is cut at an angle into two equal pieces, either of the two pieces can be used as a dielectric wheel. In the example above, the first edge has a nominal thickness and the second edge is slightly thicker than one quarter of a wavelength. In addition, there is a smooth transition from the first edge to the second edge.

As stated above, dielectric wheel 169 acts like a variable phase shifter. If the electromagnetic wave passes through the thin edge of dielectric wheel 169, the thin edge adds a nominal amount of a wavelength to the effective length. If the electromagnetic wave passes through the thick edge of dielectric wheel 169, the thick edge adds one quarter of a wavelength to the effective length. If the wheel 169 is rotated at a rate that is significantly faster than the rate at which planar material 40 moves in direction x, it is possible to effectively smooth the hot spots in cavities 30 and 60.

It will be appreciated by those skilled in the art that the number of thin edges, the number of thick edges, the thinness of the thin edges, and the thickness of the thick edges can be varied depending on the application. For example, dielectric wheel can have an hourglass shape so that a first edge is an even multiple of a quarter of a wavelength thick, a second edge is slightly greater than an odd multiple of a quarter of a wavelength thick, a third edge is an even multiple of a quarter of a wavelength thick, and a fourth edge is slightly greater than an odd multiple of a quarter of a wavelength thick. If, for example, dielectric wheel has a club (or four leaf clover) shape with four edges that are an even multiple of a quarter of a wavelength thick and four edges that are slightly greater than an odd multiple of a quarter of a wavelength thick. It is possible to rotate wheel 169 at a slower rate than a wheel with a hourglass shape and still achieve uniform heating.

Or alternatively, dielectric wheel 169 can be constructed of a single thickness with varying dielectric constants. For example, dielectric wheel 169 might have a first section that has a dielectric constant that adds one half of a wavelength or a nominal amount of a wavelength to the effective length and a second section that adds a ¼ of a wavelength to the effective length. These varying dielectric constants create a wheel that has varying effective thicknesses so that even though the wheel has a constant thickness the wheel can be used to continuously change the effective length of segments 30, 43, 60, and 66. As dielectric wheel 169 turns, the peaks 17 and valleys 18 are "pushed" or "pulled" along segments 30, 43, 60, and 66.

As stated above, dielectric wheel 169 acts like a variable phase shifter. If the electromagnetic wave passes through the first section of dielectric wheel 169, the first section adds one half of a wavelength or a nominal amount of a wavelength to the effective length. If the electromagnetic wave passes through the second section of dielectric wheel 169, the second section adds one quarter of a wavelength to the effective length. If the wheel 169 is rotated at a rate significantly faster than the rate at which planar material 40 moves in direction x, it is possible to effectively smooth the hot spots in cavities 30 and 60. It is important to note that because dielectric wheel 169 pushes and pulls the peaks and valleys, it is possible to place the wheel 169 at different and/or multiple locations along the path. For example, a wheel could be placed between section 30 and 43 and/or a wheel could be placed at the end of section 60 (as shown in FIG. 7).

Figure 8A:
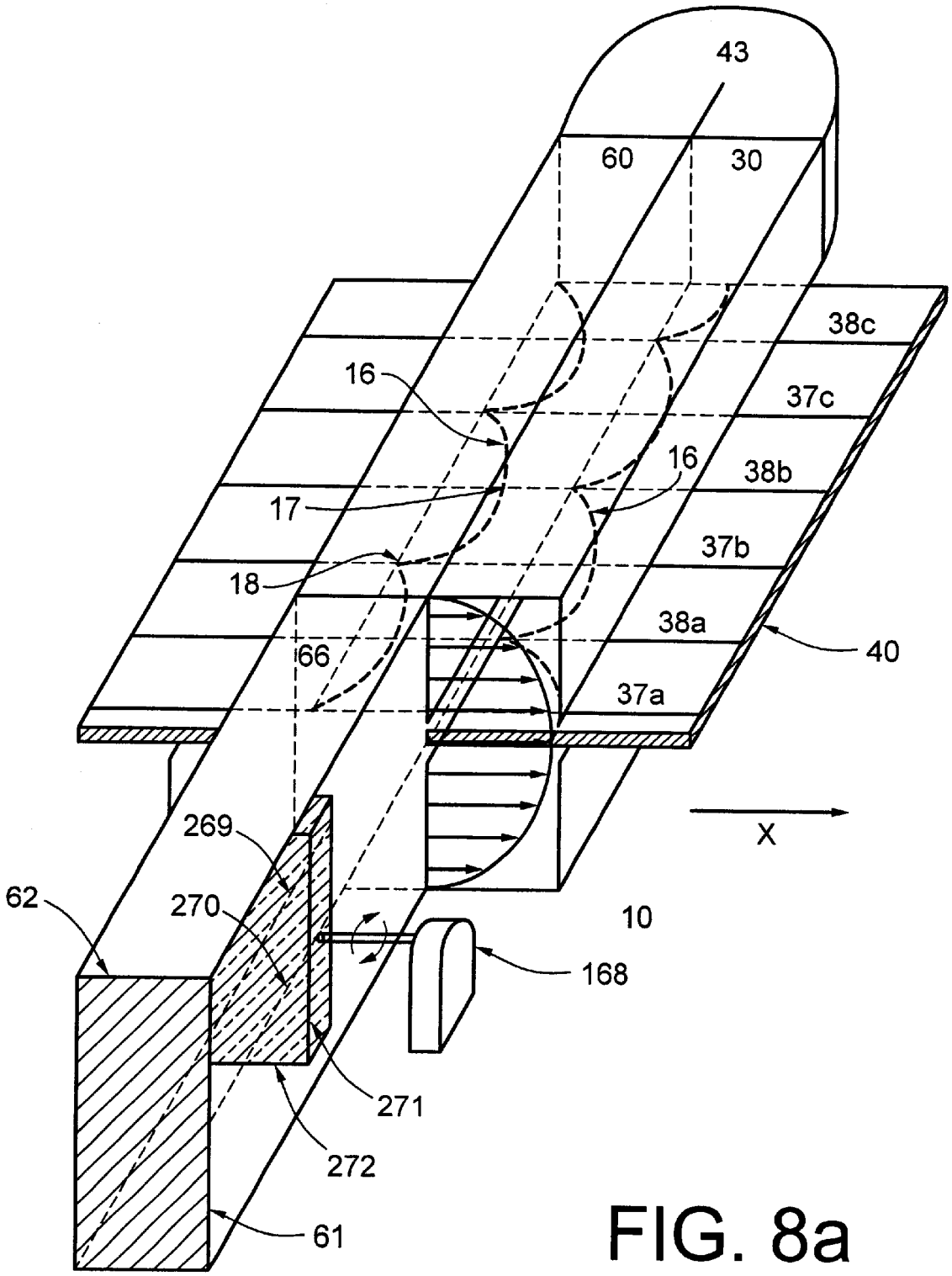
FIGS. 8*a*, 8*b*, and 8*c* are illustrations of a movable surface that can push and pull the peaks and valleys of a standing wave.

FIG. 8*a* is an illustration of a movable surface that can push and pull the peaks and valleys of a standing wave. Dielectric structure 269 has a surface 270 that has a long side 271 and a short side 272. A motor 168 rotates dielectric structure 269 about an axis parallel to the short side 272 so that when dielectric structure 269 is in a first position, the long side 271 of surface 270 is parallel to a short side 62 of segment 66, and when dielectric structure 269 is in a second position, the long side 271 of surface 270 is perpendicular to the short side 62 of segment 66.

Dielectric structure 269 can be used to change the effective length of segments 30, 43, 60, and 66. As dielectric structure 269 turns, the peaks 17 and valleys 18 are "pushed" or "pulled" along segments 66, 60, 43, and 30. If structure 269 is rotated at a rate significantly faster than the rate at which the planar material 40 moves in direction x, it is possible to effectively smooth the hot spots in cavities 30 and 60.

When dielectric structure 269 is in an upright position as shown in FIG. 8*a*, the long side 271 of surface 270 is perpendicular to the short side 62 of segment 66. When dielectric structure 269 is a horizontal position, the long side 271 of surface 270 is parallel to the short side 62 of segment 66. When dielectric structure 269 is in a horizontal position, dielectric structure 269 increases the effective length of segments 30, 43, 60, and 66. When dielectric structure 269 is an upright position, dielectric structure 269 increases the effective length of segments 30, 43, 60, and 66, but not as much as when dielectric structure 269 is in a horizontal position. The effective length of segments 30, 43, 60, and 66 appears longer when surface 270 is parallel with short side 262. As a result, the effective length of segments 30, 43, 60, and 66 is continuously changed as dielectric structure 269 rotates. It is important to note that because dielectric structure 269 pushes and pulls the peaks and valleys, it is possible to place the structure 269 at different and/or multiple locations along the path. For example, a structure could be placed between section 30 and 43 and/or a structure could be placed at the end of section 60 (as shown in FIG. 8*a*).

Figure 8B:
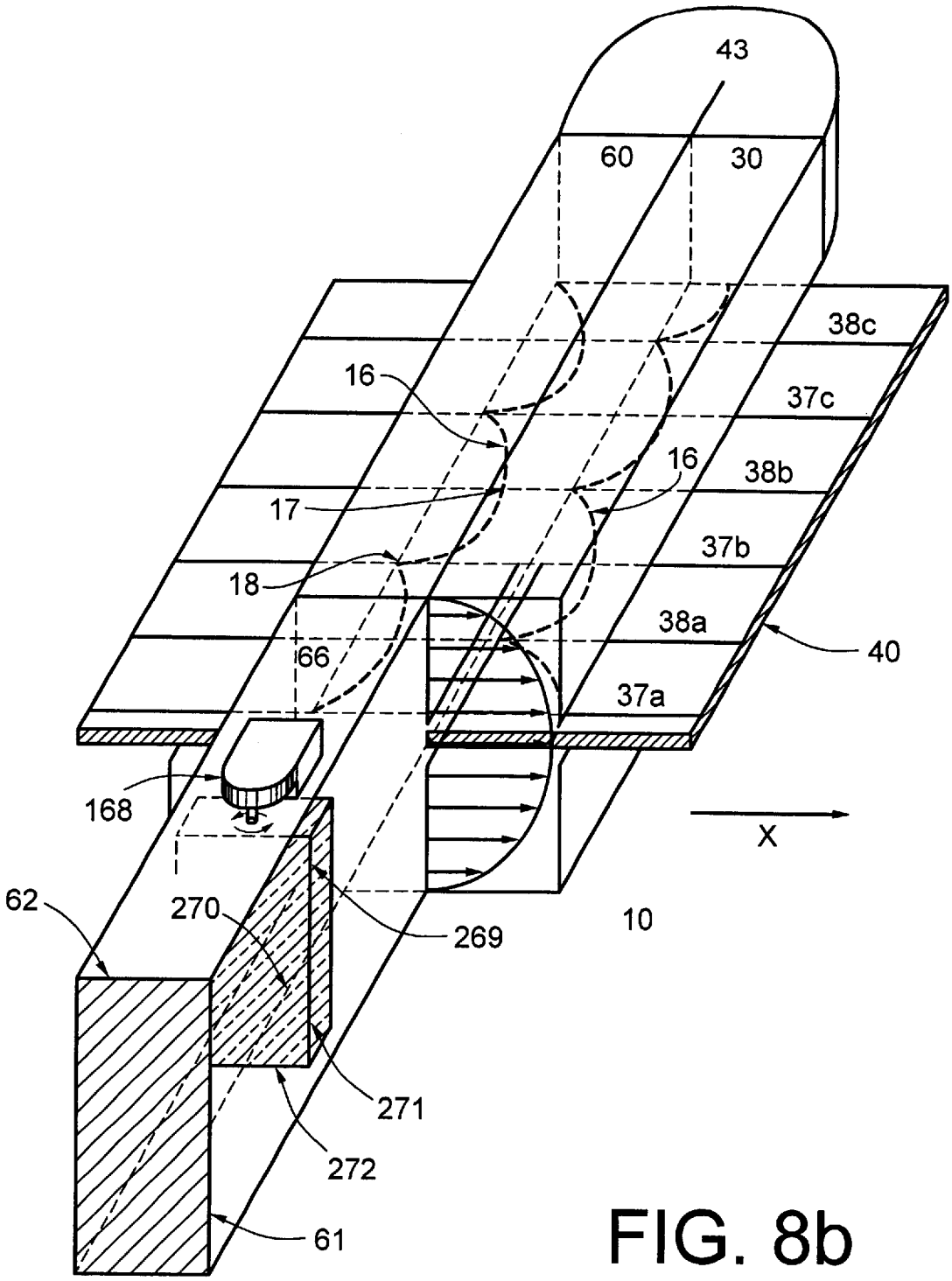

FIG. 8*b* is an illustration of a movable surface that can push and pull the peaks and valleys of a standing wave. Dielectric structure 269 has a surface 270 that has a long side 271 and a short side 272. A motor 168 rotates dielectric structure 269 about an axis parallel to the long side 271 so that when dielectric structure 269 is in a first position, the short side 272 of surface 270 is perpendicular to a long side 61 of segment 66, and when dielectric structure 269 is in a second position, the short side 272 of surface 270 is parallel to the long side 61 of segment 66.

Dielectric structure 269 can be used to sweep the effective length of segments 30, 43, 60, and 66. As dielectric structure 269 turns, the peaks 17 and valleys 18 are "pushed" or "pulled" along segments 66, 60, 43, and 30. If structure 269 is rotated at a rate significantly faster than the rate at which the planar material 40 moves in direction x, it is possible to effectively smooth the hot spots in cavities 30 and 60.

When dielectric structure 269 is in a closed position as shown in FIG. 8*b*, the short side 272 of surface 270 is perpendicular to a long side 61 of segment 66. When dielectric structure 269 is an open position, the short side 272 of surface 270 is parallel to the long side 61 of segment 66. When dielectric structure 269 is in an open position, dielectric structure 269 increases the effective length of segments 30, 43, 60, and 66. It is possible to construct dielectric structure 269 so that when dielectric structure 269 is in a closed position, dielectric structure 269 increases the effective length of segments 30, 43, 60, and 66, but not as much as when dielectric structure 269 is in an open position. As a result, the effective length of segments 30, 43, 60, and 66 is continuously changed as dielectric structure 269 rotates. It is important to note that because dielectric structure 269 pushes and pulls the peaks and valleys, it is possible to place the structure 269 at different and/or multiple locations along the path. For example, a structure could be placed between section 30 and 43 and/or a structure could be placed at the end of section 60 (as shown in FIG. 8*b*).

Figure 8C:
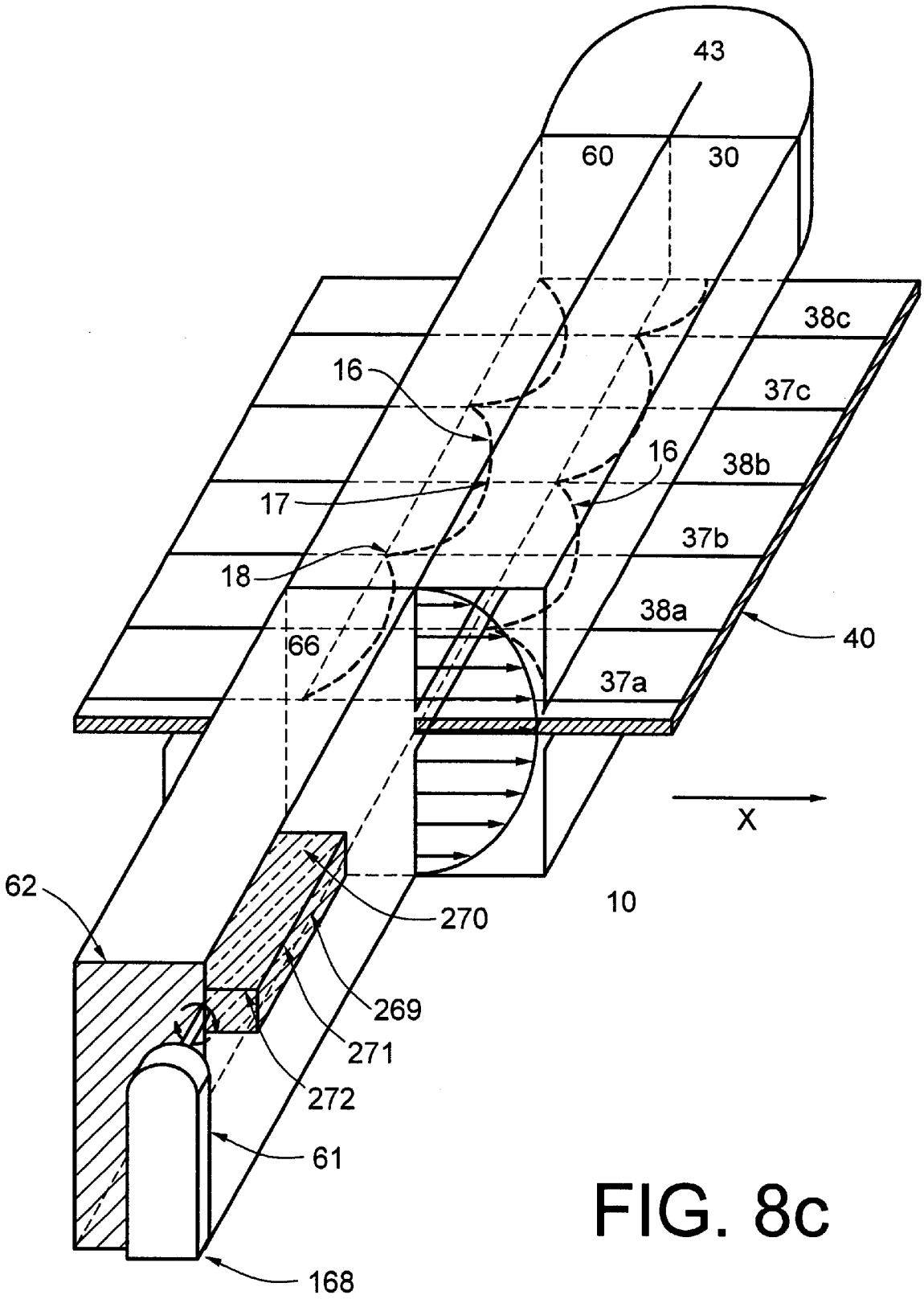

FIG. 8*c* is an illustration of a movable surface that can push and pull the peaks and valleys of a standing wave. Dielectric structure 269 has a surface 270 that has a long side 271 and a short side 272. A motor 168 rotates dielectric structure 269 about an axis parallel to the long side 271 so that when dielectric structure 269 is in a first position, the short side 272 of surface 270 is perpendicular to a long side 61 of segment 66, and when the dielectric structure 269 is in a second position, the short side 272 of surface 270 is parallel to the long side 61 of segment 66.

Dielectric structure 269 can be used to sweep the effective length of segments 30, 43, 60, and 66. As dielectric structure 269 turns, the peaks 17 and valleys 18 are "pushed" or "pulled" along segments 66, 60, 43, and 30. If structure 269 is rotated at a rate significantly faster than the rate at which the planar material 40 moves in direction x, it is possible to effectively smooth the hot spots in cavities 30 and 60.

When dielectric structure 269 is in a flat position as shown in FIG. 8*c*, a short side 272 of surface 270 is perpendicular to a long side 61 of segment 66. When dielectric structure 269 is in an upright position, the short side 272 of surface 270 is parallel to the long side 61 of segment 66. When dielectric structure 269 is in a flat position, dielectric structure 269 increases the effective length of segments 30, 43, 60, and 66. When dielectric structure 269 is in an upright position, dielectric structure increases the effective length of segments 30, 43, 60, and 66, but not as much as when dielectric structure 269 is in a flat position. The effective length of segments 30, 43, 60, and 66 appears longer when surface 270 is parallel with short side 262. As a result, the effective length of segments 30, 43, 60, and 66 is continuously changed as dielectric structure 269 rotates.

FIG. 9*a* illustrates an opening 36 with a choke flange 71 to prevent the escape of electromagnetic energy through the opening 36. Choke flange 71 may consist of a hollow or dielectrically filled conducting structure. Choke flange 71 is short circuited at a distance d of $\lambda/4$ from the outer perimeter of the opening 36. Choke flange 71 is sliced to create gaps 77. The gaps 77 prevent the electromagnetic energy from traveling along choke flange 71. It will be appreciated by those skilled in the art that to further prevent the escape of electromagnetic energy, narrow extension 76 can be added between the segment 30 and the choke flange 71 as show in FIG. 9*b*. Choke flange 71 is different from other choke flanges because the horizontal section 76 precedes the vertical section 73. The horizontal section 76 should be a width less than a half of the wavelength corresponding to the operating frequency. In a preferred embodiment, the horizontal section 76 should be a width about equal to a quarter of the wavelength corresponding to the operating frequency.

FIG. 9*c* illustrates an opening 36 with a choke flange 71 that has sections 72. If the thickness of opening 36 is small, then there is less need for choke flange 71 to have sections 72. However, for thicker openings, sections 72 should be added and shorted a distance d equal to $\lambda/4$ from the outer perimeter of opening 36. Note that $\lambda/4$ is measured with reference to the operating frequency and the value of the relative dielectric constant $\epsilon_r$ of the material inside the hollow or dielectrically filled choke flange 71. Although ideally the distance d should be equal to $\lambda/4$, choke flange 71 will still operate in accordance with the present invention if d is slightly greater or slightly less than $\lambda/4$.

Figure 9D:
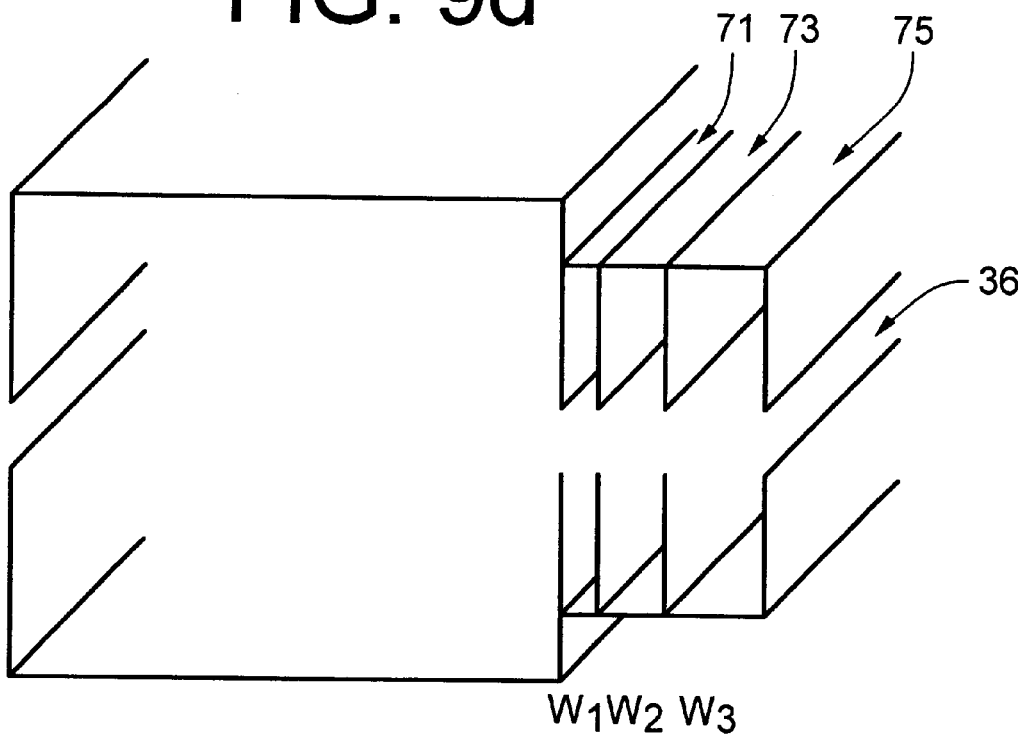
Figure 9E:
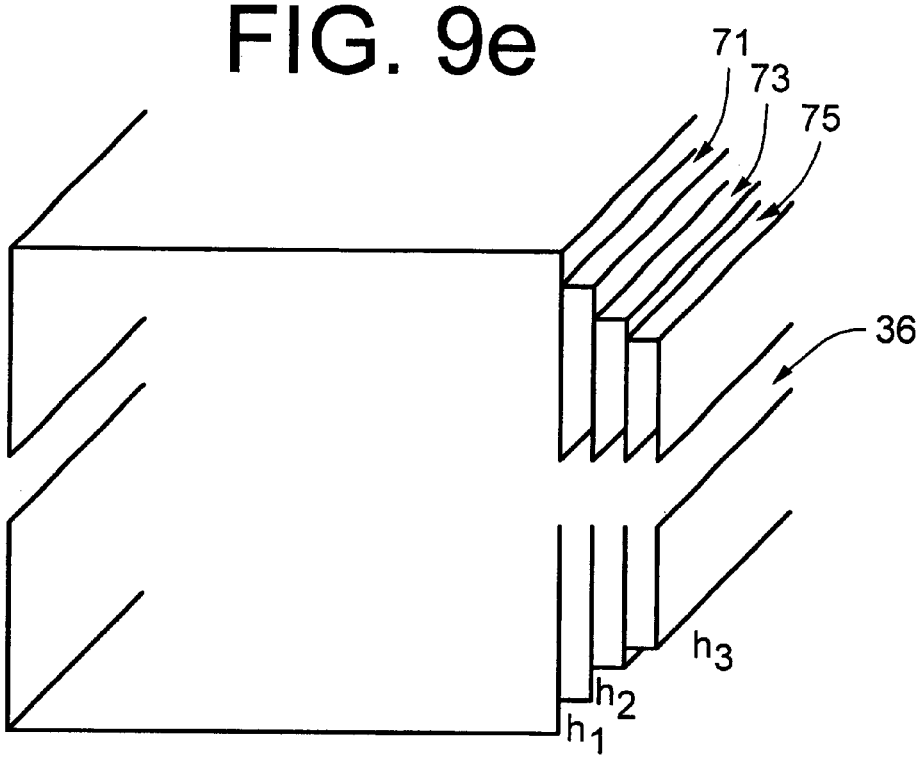

FIGS. 9*d* and 9*e* illustrate choke flanges that are specially adapted for use with swept frequencies. When using a swept frequency source, a stack of two or more choke flanges should be used to broaden the range of frequencies at which energy is choked. The choke flanges shown in FIGS. 9*d* and 9*e* are particularly useful whenever the source is not particularly stable and the frequency tends to drift or manufacturing tolerances dictate their use.

FIG. 9*d* illustrates a stack of three choke flanges 71, 73, and 75. Choke flanges 71, 73, and 75 have widths $w_1$, $w_2$, and $w_3$ respectively. In FIG. 9*e*, choke flanges 71, 73, and 75 have heights $h_1$, $h_2$, and $h_3$ respectively. Widths $w_1$, $w_2$, and $w_3$ and/or heights $h_1$, $h_2$, and $h_3$ may be varied in order to obtain the desired broadband reduction in energy leakage through opening 36. It will be appreciated by those skilled in the art that a perfect elimination of electromagnetic energy transmission through opening 36 is neither possible nor necessary. However, a satisfactory reduction in electromagnetic energy transmission may be achieved with a relatively small stack of choke flanges. There are numerous frequency versus energy reflected responses (i.e., band stop filters) known in the art. These include the Butterworth response, the maximally flat response, and others. The shape and quality of response that is desired will depend on the application and the range of frequencies that are swept. However, an appropriate set of widths $w_1$, $w_2$, and $w_3$ and/or heights $h_1$, $h_2$, and $h_3$ may be discovered for a given application without undue experimentation.

Figure 10:
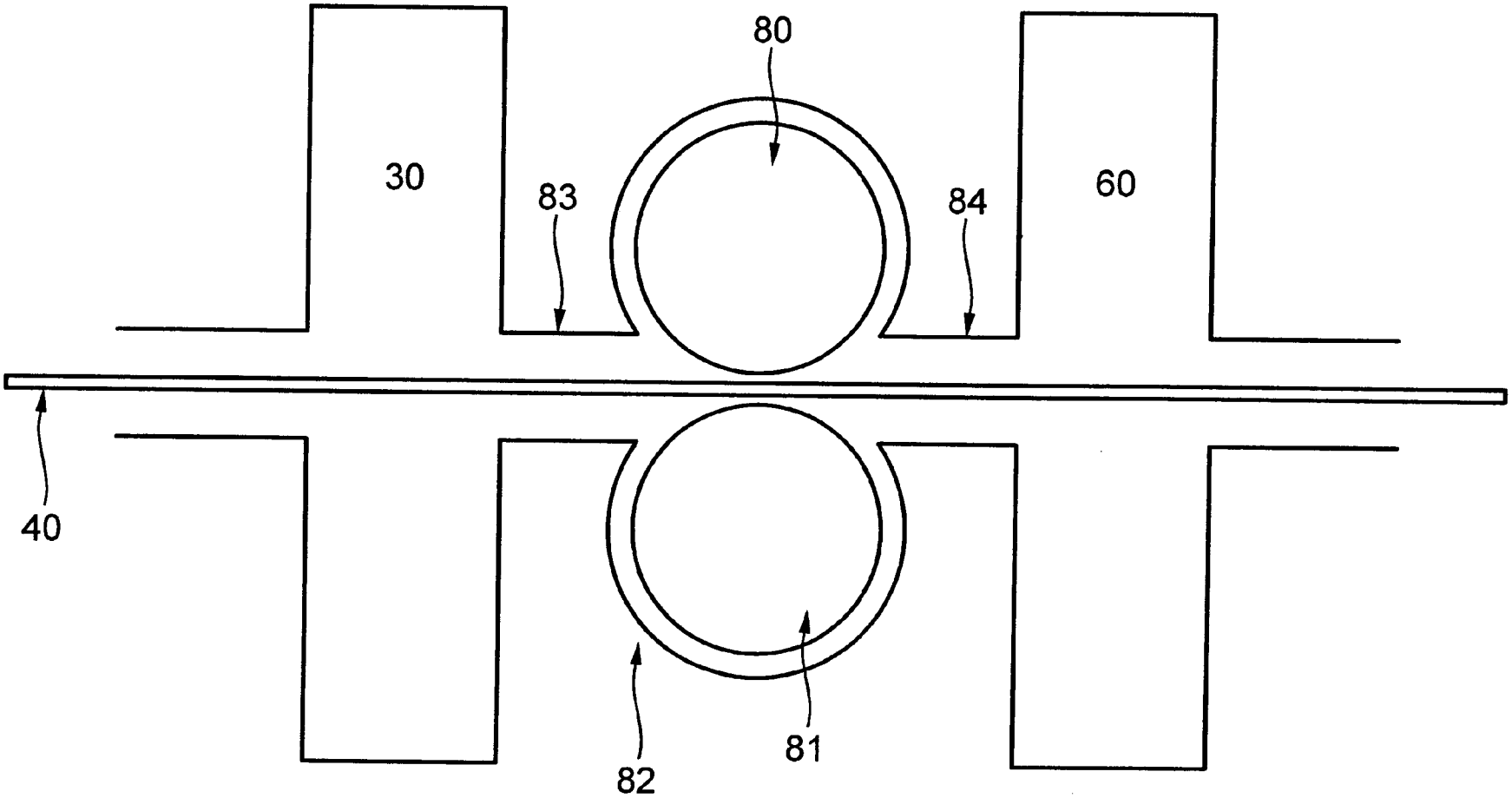
FIG. 10 is an illustration of a further embodiment of the present invention.

FIG. 10 illustrates a further embodiment of the present invention wherein roller 80 and roller 81 are placed between exposure segment 30 and exposure segment 60. Rollers 80 and 81 may be enclosed by an exterior surface 82 to prevent the escape of electromagnetic energy. Sections 83 and 84 are narrow enough that the electromagnetic wave 16 (shown in previous FIGs.) does not easily enter sections 83 and 84 and cause unwanted electromagnetic exposure of the rollers 80 and 81. It will be appreciated by those skilled in the art that the rollers 80 and 81 might be damaged by electromagnetic energy. Of course, if the rollers 80 and 81 were located in the segment 30 or the segment 60, they would likely disrupt the field, shown in previous FIGs.

Exposure segment 30 and exposure segment 60 are connected by a curved segment 44 that allows spacing for roller 80 and/or roller 81 between exposure segment 30 and exposure segment 60. The distance between exposure length 30 and exposure length 60 will depend on the size roller 80 or roller 81. Rollers 80 and 81 can be active or passive. That is, roller 80 and/or roller 81 may actually propel material 40 towards exposure segment 60 or may merely stabilize material 40.

Figure 11:
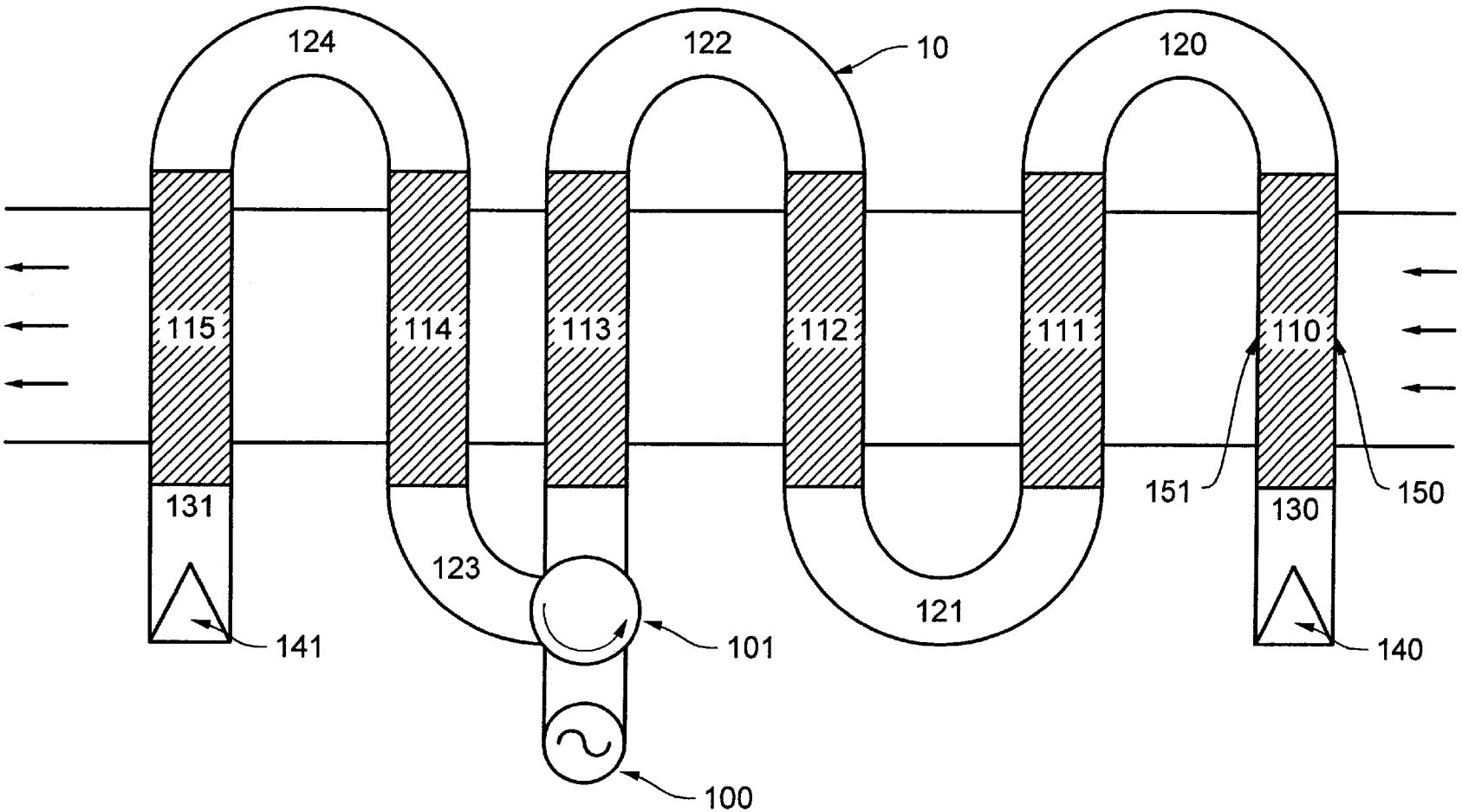
FIG. 11 is an illustration of a further embodiment of the present invention.

FIG. 11 illustrates another embodiment of the present invention. A microwave generator 100 provides an electromagnetic wave 16 (shown in previous FIGS.) to the path 10. The path 10 comprises exposure segments 110–15, curved segments 120–124, termination segments 130 and 131, and point 140 and load 141. In a preferred embodiment, segments 110–115 have perforations to facilitate evaporation and allow run off of moisture without significant energy leakage.

The circulator 101 initially provides electromagnetic wave 16 to exposure segment 113. The electromagnetic wave 16 propagates along the path 10 until it reaches point 140. If point 140 is a short circuit, the reflection of electromagnetic wave 16 creates a standing wave. Only the reflection of electromagnetic wave 16 from point 140 is allowed to propagate to exposure segment 114 and then to exposure segment 115 until it reaches load 141. Alternatively, load 141 can be placed closer to the circulator 101.

Material 40 enters exposure segment 110 via an opening 150. Opening 150 has choke flanges 170 (shown in FIG. 12). In exposure segment 110, material 40 is exposed to peaks 17 along lines 37 and valleys 18 along lines 38 (as shown in FIG. 6). Material 40 exits exposure segment via opening 151. Material 40 enters exposure segment 111 via an opening 152. In exposure segment 111, planar material 40 is exposed to valleys 18 along lines 37 and peaks 17 along lines 38.

The length of termination segments 130 and 131 are adjustable by moving the position of point 140 and load 141 respectively. By adjusting the lengths of termination segments 130 and 131, one skilled in the art can achieve more uniform heating.

In a more sophisticated embodiment, exposure segment 113 and exposure segment 114 project downward. As a result, the material 40 in segment 113 and 114 that is closest to the source 100 is farthest from the peak of the field 26 (shown in previous FIGs.). The material 40 that is the farthest from the source 100 is the closest to the peak magnitude of the field 26. Exposure segment 112 projects upward to achieve the same effect. That is, the material 40 in segment 112 that is closest to the source 100 is farthest from the peak of the field 26. The material 40 that is the farthest from the source 100 is the closest to the peak magnitude of the field 26.

Figure 12:
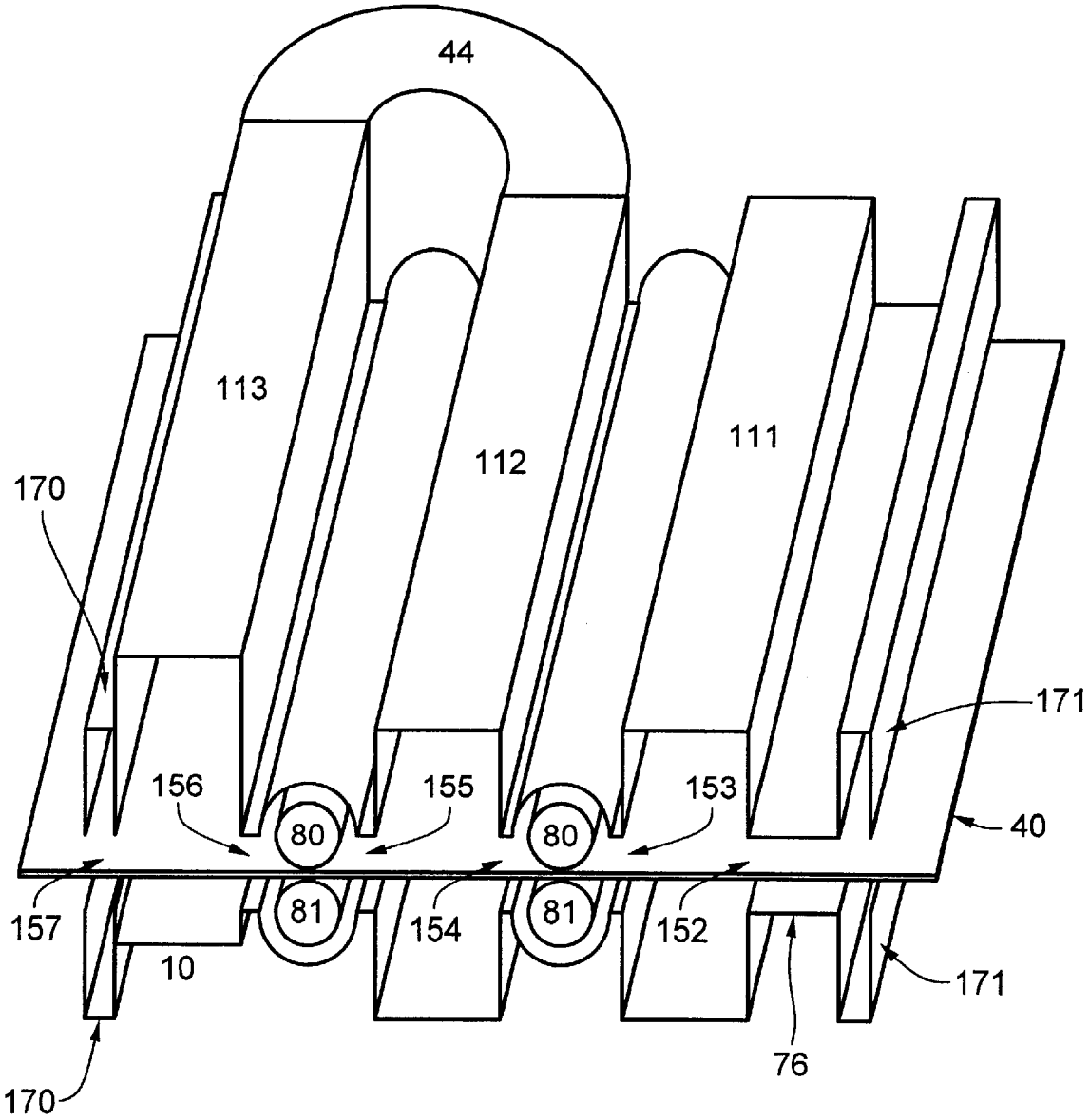
FIG. 12 is an illustration of a further embodiment of the present invention.

FIG. 12 illustrates a path in which adjacent exposure segments see-saw to provide more uniform heating. A microwave generator provides an electromagnetic wave to path 10. Path 10 comprises exposure segments 111, 112, and 113 and curved section 44. An additional curved section (not shown) connects segment 112 to segment 113. The electromagnetic wave propagates along the path 10 until it reaches a terminating point (not shown). The reflection of the electromagnetic wave creates a standing wave.

Material 40 enters exposure segment 113 via an opening 157. Opening 157 has choke flanges 170. Exposure segment 113 projects downward so that material 40 in segment 113 that is closest to the source is farthest from the peak of field 26. The material 40 that is the farthest from the source is the closest to the peak of the field 26.

Material 40 exits exposure segment 113 via an opening 156. Material 40 passes through rollers 80 and 81. Material 40 enters exposure segment 112 via an opening 155. Exposure segment 112 projects upward such that material 40 in segment 112 that is closest to the source is farthest from the peak of the field 26. The material 40 that is the farthest along the path from the source is the closest to the peak of the field 26. Material 40 exits segment 112 via an opening 154. Material 40 passes through a second set of rollers 80 and 81. Material 40 enters segment 111 via an opening 153 and exits segment 111 via an opening 152. Finally, material 40 passes through a narrow section 76 that has choke flanges 171.

While the foregoing description makes reference to particular illustrative embodiments, these examples should not be construed as limitations. For example, the description frequently refers to a planar material that is passed through a slotted waveguide. However, it will be evident to those skilled in the art that the disclosed invention can be used to heat a wide range of materials in a wide range of cavities. Thus, the present invention is not limited to the disclosed embodiments, but is to be accorded the widest scope consistent with the claims below.

What is claimed is:

1. A device for heating a material, the device comprising:

a path having a first conductive surface and a second conductive surface, the path having a first end and a second end;

a source, the source generating an electromagnetic wave that has a range of frequencies and that propagates in a direction from the first end to the second end; and an elongated slot between the first conductive surface and the second conductive surface, the slot extending in a direction from the first end to the second end.

2. A device as described in claim 1, the second end comprising a conductive surface for reflecting the electromagnetic wave.

3. A device as described in claim 1, the second end comprising a matched load.

4. A device as described in claim 1, the device further comprising a second elongated slot.

5. A device as described in claim 1, wherein the electromagnetic wave forms an electric field between the first conductive surface and the second conductive surface that has a peak region and an off-peak region.

6. A device as described in claim 5, wherein at least part of the elongated slot is aligned with the off-peak region.

7. A device as described in claim 6, the path having a cutoff frequency, the source sweeping a frequency of the electromagnetic wave between the cutoff frequency and double the cutoff frequency.

8. A device as described in claim 6, wherein part of the elongated slot is aligned with a region that is more off-peak and part of the elongated slot is aligned with a region that is less off-peak.

9. A device as described in claim 8, the path having a cutoff frequency, the source sweeping a frequency of the electromagnetic wave between the cutoff frequency and double the cutoff frequency.

10. A device as described in claim 8, wherein the elongated slot is aligned at the first end with a region that is more off-peak and at the second end with a region that is less off-peak.

11. A device as described in claim 10, the path having a cutoff frequency, the source sweeping a frequency of the electromagnetic wave between the cutoff frequency and double the cutoff frequency.

12. A device as described in claim 11, the device further comprising a second choke flange shorted to the exterior conductive surface, the second choke flange extending from the outer perimeter of the slot a second distance equal to a ¼ of a wavelength of an electromagnetic wave at a second frequency in the range of frequencies.

13. A device as described in claim 12, wherein the first choke flange has a width $w_1$, the second choke flange has a width $w_2$, and $w_1$ and $w_2$ are selected to minimize the escape of electromagnetic energy from the path.

14. A device as described in claim 12, wherein the first choke flange has a height $h_1$, the second choke flange has a height $h_2$, and $h_1$ and $h_2$ are selected to minimize the escape of electromagnetic energy from the path.

15. A device as described in claim 14, wherein the first choke flange has a width $w_1$, the second choke flange has a width $w_2$, and $w_1$ and $w_2$ are selected to minimize the escape of electromagnetic energy from the path.

16. A device as described claim 1, the path having a cutoff frequency, the source sweeping a frequency of the electromagnetic wave between the cutoff frequency and double the cutoff frequency.

17. A device as described in claim 1, the device further comprising a choke flange that is shorted to an exterior conductive surface of the path, the choke flange extending from an outer perimeter of the slot a first distance equal to a ¼ of a wavelength of an electromagnetic wave at a first frequency in the range of frequencies.

18. A device as described in claim 17, wherein the first distance and the second distance correspond to a frequency versus energy reflected response.

19. A device for heating a material, the device comprising:

a first conducting surface;

a second conducting surface, the second conducting surface opposite the first conducting surface;

a source, the source operable to create an electromagnetic field between the first conducting surface and the second conducting surface;

an opening through a surface connecting the first conducting surface and the second conducting surface, the opening being positioned such that a region of a material passed through the opening is exposed to an off-peak region of the electromagnetic field between the two conducting surfaces; and an opening adjuster.

20. A device as described in claim 19, wherein the opening adjuster adjusts the location of the opening to increase or decrease the amount of heating.

21. A device as described in claim 19, wherein the opening adjuster adjusts the angle or effective angle of the opening in accordance with the lossiness of the material.

22. A device as described in claim 19, wherein the first conducting surface is a movable surface.

23. A device as described in claim 22, wherein the two conducting surfaces form a path that has a first end and a second end and the opening adjuster is configured to increase or decrease the distance between the two conducting surfaces an equal amount at the first end and the second end.

24. A device as described in claim 22, wherein the two conducting surfaces form a path that has a first end and a second end and the opening adjuster is configured to increase or decrease the distance between the two conducting surfaces more at the first end than at the second end.

25. A device as described in claim 19, wherein the opening is a diagonal opening and the opening adjuster is operable to change the angle of the diagonal opening.

26. A device as described in claim 19, wherein the opening is a diagonal opening and the opening adjuster is operable to change the effective angle of the diagonal opening.

* * * * *